US006257191B1

(12) United States Patent
Kutlucinar

(10) Patent No.: US 6,257,191 B1
(45) **Date of Patent: *Jul. 10, 2001**

(54) ROTARY VALVE SYSTEM

(76) Inventor: Isken Kutlucinar, 4108 Wexford Dr., Kensington, MD (US) 20895

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/926,879

(22) Filed: Sep. 10, 1997

Related U.S. Application Data

(63) Continuation-in-part of application No. 08/712,468, filed on Sep. 11, 1996.

(51) Int. Cl.[7] ..... F01L 7/00

(52) U.S. Cl. ..... 123/190.6; 123/190.4; 123/190.8

(58) Field of Search ..... 123/190.4, 190.5, 123/190.6, 190.8

(56) References Cited

U.S. PATENT DOCUMENTS

| | | |
|---|---|---|
| 1,782,389 | 12/1930 | Rauha, Jr. et al. . |
| 2,217,853 | 9/1940 | Baer . |
| 2,714,882 | 12/1955 | Brevard . |
| 3,871,340 | 3/1975 | Zimmerman . |
| 3,948,227 | 4/1976 | Guenther . |
| 4,008,694 | 2/1977 | Monn . |
| 4,016,840 | 4/1977 | Lockshaw . |
| 4,019,487 | 4/1977 | Guenther . |
| 4,022,178 | 5/1977 | Cross et al. . |
| 4,036,184 | 7/1977 | Guenther . |
| 4,037,572 | 7/1977 | Franz . |
| 4,077,382 | 3/1978 | Gentile . |
| 4,083,331 | 4/1978 | Guenther . |
| 4,098,238 | 7/1978 | Vallejos . |
| 4,098,514 | 7/1978 | Guenther . |
| 4,114,639 | 9/1978 | Cross et al. . |
| 4,116,189 | 9/1978 | Asaga . |
| 4,134,381 | 1/1979 | Little . |
| 4,149,493 | 4/1979 | Franke . |
| 4,160,436 | 7/1979 | Flower . |
| 4,163,438 | 8/1979 | Guenther et al. . |
| 4,169,434 | 10/1979 | Guenther . |
| 4,198,946 | 4/1980 | Rassey . |
| 4,201,174 | 5/1980 | Vallejos . |
| 4,244,338 | 1/1981 | Rassey . |

(List continued on next page.)

FOREIGN PATENT DOCUMENTS

| | | |
|---|---|---|
| 2508381 A1 | 2/1975 | (DE) . |
| 2805260 A1 | 2/1978 | (DE) . |
| 4017822 A1 | 1/1991 | (DE) . |
| 0 197 204 | 11/1983 | (EP) . |
| WO 91/00953 | 1/1991 | (EP) . |

*Primary Examiner*—Henry C. Yuen
*Assistant Examiner*—Hai Huynh
(74) *Attorney, Agent, or Firm*—Gardner, Carton & Douglas

(57) ABSTRACT

A complete rotary valve assembly and system is disclosed. The rotary valve includes a generally elongated valve body having first and second ends and a longitudinally extending axis of rotation. The rotary valve is mounted in a housing positioned above a head port of an engine. The rotary valve includes an intake port and an exhaust port defined by a valve body arranged for periodic communication with the head port and combustion chamber as the valve rotates along the axis of rotation. The rotary valve system of the present invention includes a secondary intake port for controlling the flow of intake gases into the rotary valve, a fuel injection system, an improved sealing system, a bifurcated valve body with separated intake and exhaust passages, a cooling and reduced emissions gas exhaust control system, and an adjustable throttle control.

9 Claims, 13 Drawing Sheets

U.S. PATENT DOCUMENTS

| | | |
|---|---|---|
| 4,271,800 | 6/1981 | Borracci . |
| 4,279,225 | 7/1981 | Kersten . |
| 4,311,119 | 1/1982 | Menzies et al. . |
| 4,313,401 | 2/1982 | Monn . |
| 4,313,404 | 2/1982 | Kossel . |
| 4,321,893 | 3/1982 | Yamamoto . |
| 4,333,427 | 6/1982 | Burrillo et al. . |
| 4,342,294 | 8/1982 | Hopkins . |
| 4,347,821 | 9/1982 | Saito . |
| 4,354,459 | 10/1982 | Maxey . |
| 4,370,955 | 2/1983 | Ruggeri . |
| 4,373,476 | 2/1983 | Vervoordt et al. . |
| 4,381,737 | 5/1983 | Turner . |
| 4,392,460 | 7/1983 | Williams . |
| 4,404,934 | 9/1983 | Asaka et al. . |
| 4,421,077 | 12/1983 | Ruggeri . |
| 4,444,161 | 4/1984 | Williams . |
| 4,467,751 | 8/1984 | Asaka et al. . |
| 4,473,041 | 9/1984 | Lyons et al. . |
| 4,481,917 | 11/1984 | Rus et al. . |
| 4,484,543 | 11/1984 | Maxey . |
| 4,494,500 | 1/1985 | Hansen . |
| 4,506,636 | 3/1985 | Negre et al. . |
| 4,515,113 | 5/1985 | DeLorean . |
| 4,517,938 | 5/1985 | Kruger . |
| 4,541,371 | 9/1985 | Kageyama et al. . |
| 4,545,337 | 10/1985 | Lyons et al. . |
| 4,546,743 | 10/1985 | Eickmann . |
| 4,553,385 | 11/1985 | Lamont . |
| 4,554,890 | 11/1985 | Okimoto et al. . |
| 4,556,023 | 12/1985 | Giocastro et al. . |
| 4,562,796 | 1/1986 | Eickmann . |
| 4,574,749 | 3/1986 | Negre . |
| 4,592,312 | 6/1986 | Hepko . |
| 4,597,321 | 7/1986 | Gabelish et al. . |
| 4,606,309 | 8/1986 | Fayard . |
| 4,610,223 | 9/1986 | Karlan . |
| 4,612,886 | 9/1986 | Hansen et al. . |
| 4,622,928 | 11/1986 | Uchinishi . |
| 4,632,082 | 12/1986 | Hattori et al. . |
| 4,658,776 | 4/1987 | Coman . |
| 4,682,572 | 7/1987 | Hepko . |
| 4,699,093 | 10/1987 | Byer . |
| 4,730,545 | 3/1988 | Eickmann . |
| 4,739,737 | 4/1988 | Kruger . |
| 4,742,802 | 5/1988 | Kruger . |
| 4,751,900 | 6/1988 | Ruffolo . |
| 4,770,145 | 9/1988 | Satomi et al. . |
| 4,773,364 | 9/1988 | Hansen et al. . |
| 4,776,306 | 10/1988 | Matsuura et al. . |
| 4,777,917 | 10/1988 | Williams . |
| 4,778,148 | 10/1988 | Kruger . |
| 4,782,656 | 11/1988 | Hansen . |
| 4,782,801 | 11/1988 | Ficht et al. . |
| 4,788,945 | 12/1988 | Negre . |
| 4,794,895 | 1/1989 | Kruger . |
| 4,813,392 | 3/1989 | Hansen et al. . |
| 4,815,428 | 3/1989 | Bunk . |
| 4,821,692 | 4/1989 | Browne . |
| 4,834,038 | 5/1989 | Montagni . |
| 4,838,220 | 6/1989 | Parsons . |
| 4,852,532 | 8/1989 | Biship . |
| 4,858,577 | 8/1989 | Matsuura et al. . |
| 4,864,980 | 9/1989 | Riese . |
| 4,864,984 | 9/1989 | Blish . |
| 4,864,985 | 9/1989 | Slee . |
| 4,867,117 | 9/1989 | Scalise . |
| 4,879,979 | 11/1989 | Triguero . |
| 4,887,567 | 12/1989 | Matsuura et al. . |
| 4,889,091 | 12/1989 | Berkowitz et al. . |
| 4,898,042 | 2/1990 | Parsons . |
| 4,920,934 | 5/1990 | Pizzicara . |
| 4,926,809 | 5/1990 | Allen . |
| 4,932,369 | 6/1990 | Parr . |
| 4,941,261 | 7/1990 | Coates . |
| 4,944,262 | 7/1990 | Molina et al. . |
| 4,949,685 | 8/1990 | Doland et al. . |
| 4,949,686 | 8/1990 | Brusutti . |
| 4,953,527 | 9/1990 | Coates . |
| 4,960,086 | 10/1990 | Rassey . |
| 4,969,918 | 11/1990 | Taniguchi . |
| 4,976,227 | 12/1990 | Draper . |
| 4,976,232 | 12/1990 | Coates . |
| 4,987,864 | 1/1991 | Cantrell et al. . |
| 4,989,558 | 2/1991 | Coates . |
| 4,989,576 | 2/1991 | Coates . |
| 4,995,354 | 2/1991 | Morikawa . |
| 4,998,512 | 3/1991 | Masuda et al. . |
| 5,000,131 | 3/1991 | Masuda . |
| 5,000,136 | 3/1991 | Hansen et al. . |
| 5,003,942 | 4/1991 | Hansard . |
| 5,005,543 | 4/1991 | Triguero . |
| 5,016,583 | 5/1991 | Blish . |
| 5,052,346 | 10/1991 | Buelna . |
| 5,052,349 | 10/1991 | Buelna . |
| 5,074,265 | 12/1991 | Ristin et al. . |
| 5,076,219 | 12/1991 | Pellerin . |
| 5,081,961 | 1/1992 | Paul et al. . |
| 5,081,966 | 1/1992 | Hansen et al. . |
| 5,095,870 | 3/1992 | Place et al. . |
| 5,103,778 | 4/1992 | Usich, Jr. . |
| 5,105,784 | 4/1992 | Davis et al. . |
| 5,109,814 | 5/1992 | Coates . |
| 5,111,783 | 5/1992 | Moore . |
| 5,127,376 | 7/1992 | Lynch . |
| 5,152,259 | 10/1992 | Bell . |
| 5,154,147 | 10/1992 | Muroki . |
| 5,191,863 | 3/1993 | Hagiwara . |
| 5,197,434 | 3/1993 | Orellana . |
| 5,205,245 | 4/1993 | Flack et al. . |
| 5,205,251 | 4/1993 | Conklin . |
| 5,230,314 | 7/1993 | Kawahara et al. . |
| 5,249,553 | 10/1993 | Guiod . |
| 5,251,591 | 10/1993 | Corrin . |
| 5,255,645 | 10/1993 | Templeton . |
| 5,267,535 | 12/1993 | Luo . |
| 5,273,004 | 12/1993 | Duret et al. . |
| 5,287,701 | 2/1994 | Klaue . |
| 5,309,871 | 5/1994 | Kadlicko . |
| 5,309,876 | 5/1994 | Schiattino . |
| 5,315,962 | 5/1994 | Renault et al. . |
| 5,315,963 | 5/1994 | Warf . |
| 5,315,969 | 5/1994 | MacMillan . |
| 5,329,897 | 7/1994 | Hemphill et al. . |
| 5,345,758 | 9/1994 | Bussing . |
| 5,353,588 | 10/1994 | Richard . |
| 5,359,855 | 11/1994 | Klaue . |
| 5,361,739 | 11/1994 | Coates . |
| 5,372,104 | 12/1994 | Griffin . |
| 5,377,635 | 1/1995 | Glover . |
| 5,392,743 | 2/1995 | Dokonal . |
| 5,398,647 | 3/1995 | Rivera . |
| 5,410,996 | 5/1995 | Baird . |
| 5,417,188 | 5/1995 | Schiattino . |
| 5,431,130 | 7/1995 | Brackett . |
| 5,437,252 | 8/1995 | Glover . |
| 5,438,964 | 8/1995 | Breidenbach . |
| 5,448,971 | 9/1995 | Blundell et al. . |
| 5,474,036 | 12/1995 | Hansen et al. . |
| 5,482,011 | 1/1996 | Falck . |
| 5,490,485 | 2/1996 | Kutlucinar . |
| 5,497,736 | 3/1996 | Miller et al. . |

5,503,124 4/1996 Wallis .
5,503,130 4/1996 Pomeisl .
5,509,386 4/1996 Wallis et al. .
5,513,489 5/1996 Bussing .
5,524,579 6/1996 Eluchans .
5,526,780 6/1996 Wallis .
5,529,037 6/1996 Wallis .
5,535,715 7/1996 Mouton .
5,540,054 7/1996 Bullivant .
5,558,049 9/1996 Dubose .
5,579,730 12/1996 Dubose .
5,579,734 12/1996 Muth .

FIG. 16A
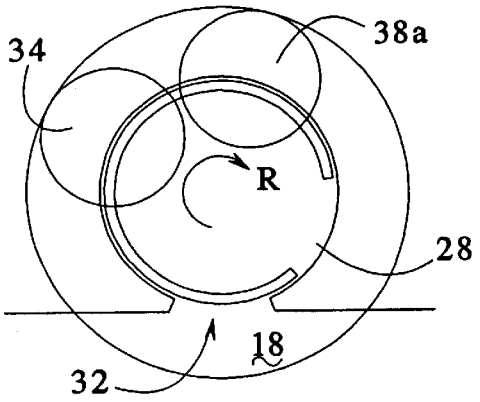
FIG. 16B
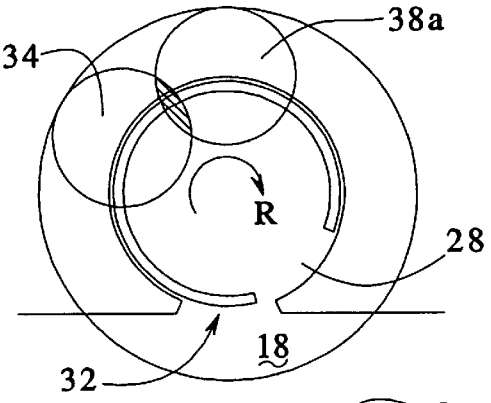
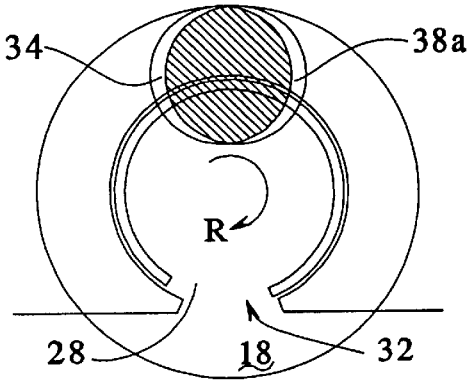
FIG. 16C
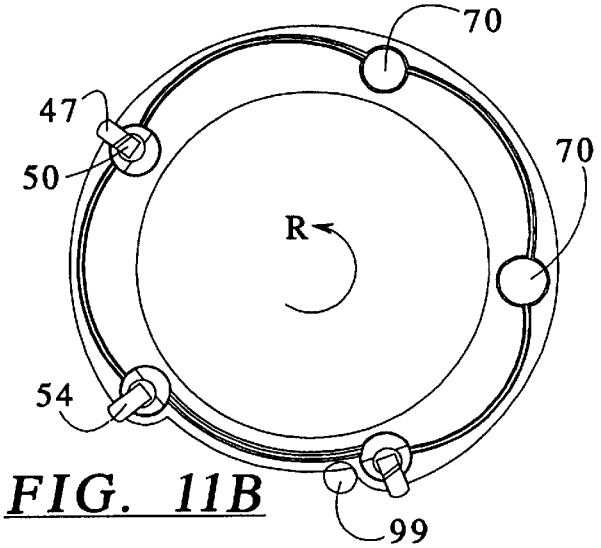
FIG. 11B
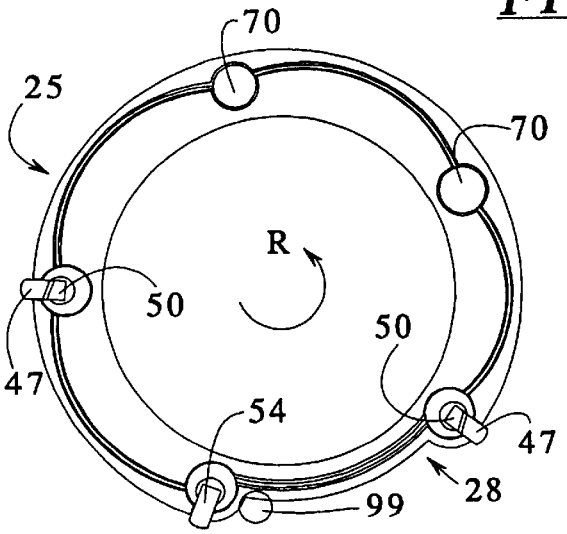
FIG. 11A
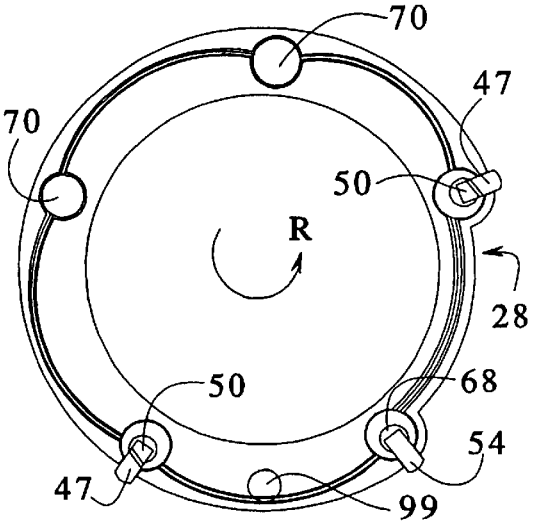
FIG. 11C

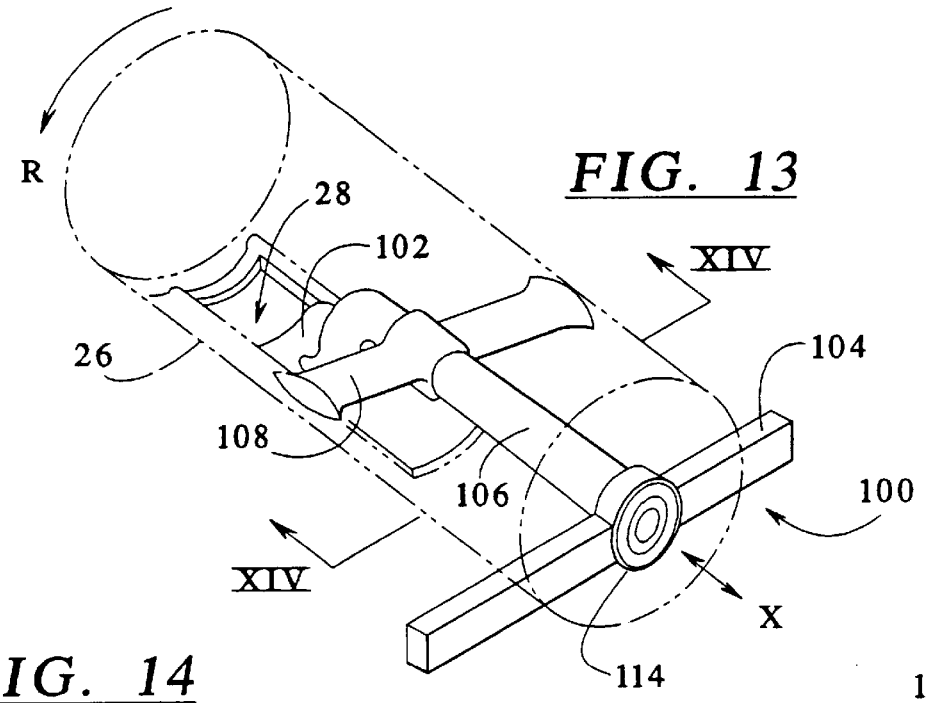
FIG. 13
FIG. 14
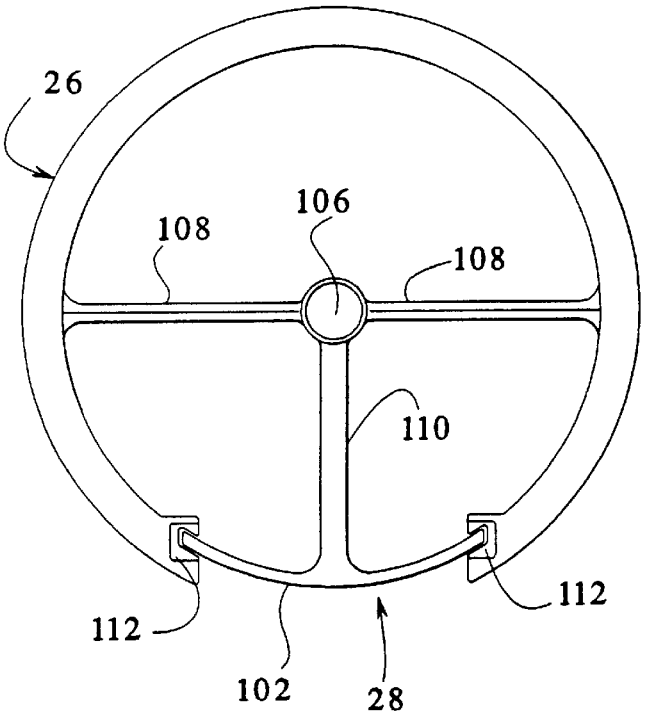
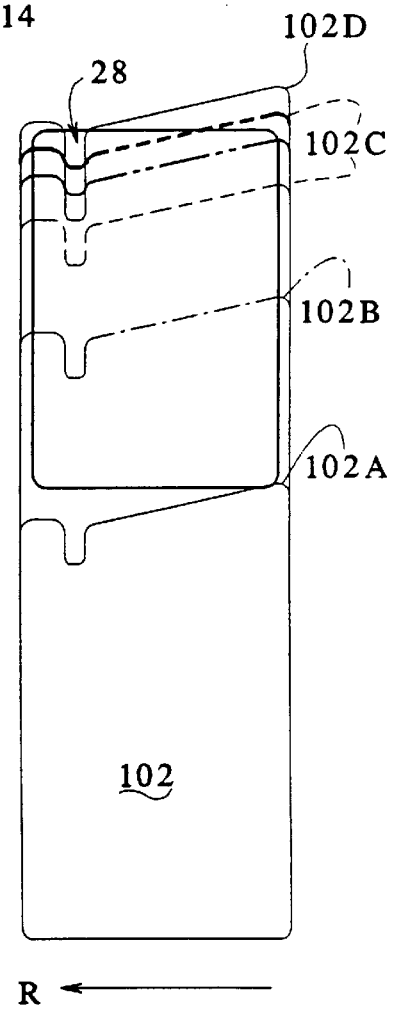
FIG. 15

ROTARY VALVE SYSTEM

RELATED APPLICATIONS

This application is a continuation-in-part application of Ser. No. 08/712,468 filed Sep. 11, 1996.

BACKGROUND OF THE INVENTION

This invention relates to rotary valves for internal combustion engines. More particularly, the invention relates to a rotary valve system which includes a secondary intake port for controlling the inflow of intake gases into the rotary valve, a fuel injection system, a sealing system, a cooling and emission gas exhaust control system, and a throttle control system.

Rotary valve systems typically include one or more rotating cylinders or tubes which are mounted in the engine head and include intake and/or exhaust ports which periodically communicate with the combustion chamber as the tube rotates. Intake and exhaust gases pass through the cylindrical tube and are forced into or evacuated from the combustion chamber when the respective ports are aligned with the port of the cylinder head. Such rotary valves are believed to be superior to traditional poppet valves which have complicated drive systems including a cam shaft, lifter rods, rocker arms and springs. For example, the maximum rpm of conventional combustion engines is limited by the complicated operation of the poppet valves. In contrast, combustion engines that employ rotary valves include no such limitation and it is believed that such rotary valve engines can idle at rpms of about 400 to 600 rpm and have a high speed operation at about 10,000 to 25,000 rpm.

In addition to the improved performance of the engine, there are many other advantages of the rotary valve system over the traditional poppet systems. For example, one recognized disadvantage of traditional poppet valve systems, and prior art rotary valve systems, is that the intake mixture is subjected to at least three drastic changes of pressure. Most notably, the intake mixture achieves a high pressure behind the poppet valve when the poppet valve closes. This high pressure causes the atomized fuel particles to combine to form larger fuel particles behind the intake valve. Such larger fuel particles require significantly longer burning times and are sometimes not completely burned. This results in inefficient combustion of the intake mixture and emission problems due to the unburned fuel contained in the exhaust. Similarly, prior art rotary valves have allowed the intake mixture to develop a high pressure within the tube of the rotary valve between the periodic alignment of the intake port and the combustion chamber. When the intake port rotates into alignment with the combustion chamber, the high pressure intake mixture goes into the combustion chamber and includes large fuel particles which hinder efficient combustion and result in emission problems. Such prior art rotary valves are disclosed in, for example, U.S. Pat. Nos. 4,949,685 and 5,152,259.

Another area of recognized inefficiency in both traditional poppet valves systems and the prior art rotary valve systems is that the systems use indirect fuel injection. In particular, the fulel is injected at a fuel injection system or carburetor at the top of an intake manifold and the intake mixture must then flow through the manifold and eventually to the valving system. It is believed that it would be an improvement in the combustion engine art to provide a direct or a semi-direct fuel injection system which would directly inject the fuel into the combustion chamber. Such direct injection of the fuel results in better atomization of the fuel for more efficient combustion and less emission problems.

Most automobile engines have similar camshaft timing which does not provide for optimum operation at idle or high speeds. In such constructions, the intake valve typically opens approximately 25 degrees before top dead center and closes approximately 65 degrees after bottom dead center. Such a compromise of valve timing is a necessary sacrifice between the proper idling rpm and high rpm horsepower. As a result, performance suffers under both of these conditions. During low speed or idle operation, the intake valve closes 65 degrees after the piston passes bottom dead center. As a result, some charged air is pushed back out of the combustion chamber. Therefore, there is a requirement that a large intake manifold be provided to absorb and hold approximately 25% of this discharged air and fuel mixture until the next intake valve opening. Such a large intake manifold adds weight and cost to the vehicle.

In contrast, during high engine speed operation, by the time the intake valve closes, the pressures in the intake manifold and combustion chamber are equal, and there is no more air movement into the combustion chamber. This limits the engine rpm potential. Late intake valve closing provides higher engine rpm and creates more horsepower. However, early intake valve closing provides better idling characteristics since closing early traps more air in the combustion chamber. Under load, early intake valve closing will limit the amount of air entering the combustion chamber since there is not enough time, and the engine cannot produce enough torque or horsepower to exceed 3,000 rpm. As a result, variable camshaft timing has been introduced by some engine manufacturers in an attempt to reach the best of both conditions. However, such systems are complex, expensive and generally available only on high end automobiles. Accordingly, it is believed that it would be an improvement in the engine design field to provide a rotary valve which provides for optimum operations at both idle and high speed operation.

One obstacle which has been encountered in providing a successful rotary valve is that the rotating cylinder or tube is difficult to seal within the cylinder head. During the combustion stage, leakage of high-pressure combustion gases in the junction between the rotary valve and cylinder head can damage the surfaces of the rotary valve and cylinder head and also damage the bearing assemblies which support the rotary valve. Escape of the combustion gases also reduces the power imparted to the piston within the cylinder. During the intake phase, leakage of ambient air into the fuel/air mixture can significantly affect that mixture and severely impede the performance of the combustion engine. In addition, leakage of unburned air/fuel mixture into the exhaust gases can cause significant emission problems.

Many efforts to provide an effective sealing system for a rotary valve have concentrated on providing seals in the cylinder head around the head port which leads to the combustion chamber, such as those disclosed in U.S. Pat. Nos. 4,022,178, 4,114,639 and 4,794,895. Such seals are fixed in the cylinder head and constantly engage the same portion of the rotary valve so that lubrication has little opportunity to enter the junction between the seals and the valve. Such sealing systems are also only effective to seal one of the ports at a time when it is exactly aligned over the head port. When the ports are not aligned or are only partially aligned with the head port, they are open to the juncture between rotary valve and the valve housing and the intake and exhaust gases are free to flow along and damage the surfaces of the rotary valve and valve housing. The intake and exhaust gases also have ample opportunity to commingle and cause air/fuel mixture and emission problems.

Other sealing systems have included both a set of annular seals mounted on the valve, which seal the flow of gases in the longitudinal direction, and a set of axial seals mounted in the cylinder head and extending along the head port for sealing the port in the radial direction, such as disclosed in U.S. Pat. Nos. 4,019,487, 4,852,532 and PCT Publication WO 94/11618.

In such constructions, variations in the movement of the rotary valve within the head causes poor alignment between the annular and axial seals, resulting in leakage of hot combustion gases between the seals and along the valve and head surfaces. In addition, there is nothing to restrain leakage radially between the ports, which allows unburned air/fuel mixture to enter the exhaust gases and cause emission problems. Moreover, all of the seals are subject to significant size changes due to the varying range of temperatures encountered by the rotary valve. For example, the axial seals must be necessarily short so that they can expand between the annular seals during elevated operation temperatures. However, this undersizing of the axial seals leaves a gap between the axial and annular seals which allows commingling of intake and exhaust gases between the intake and exhaust ports. Accordingly, it would be an improvement in this art to provide an effective sealing system for a rotary valve.

SUMMARY OF THE INVENTION

The rotary valve system of this invention is designed and constructed to overcome the above-mentioned shortcomings of the prior art, as well as to provide additional beneficial features in one complete system for providing rotary valve operation in an internal combustion engine. The rotary valve of this invention provides several features to eliminate the problems encountered in the prior art. For example, a secondary intake port for controlling the inflow of intake gases into the rotary valve is provided. The secondary intake port prevents gases from building up under high pressure within the valve body as in the prior art systems. In addition, the complete rotary valve system of the present invention provides a fuel injection system which uses a regular solenoid-controlled injector in the engine head to inject fuel into the combustion chamber directly. In addition, the fuel injector is positioned such that the nozzle of the injector is advantageously hidden behind gas seals provided on the rotary valve. This provides the advantage of protecting the fuel injector from the explosions in the combustion chamber, as well as protecting the injector from the high temperatures resulting therefrom. Doing so increases the life of the injector.

The rotary valve system of this invention also includes a vastly improved sealing system that facilitates more complete combustion and greatly improves the sealing capabilities of the rotary valve over the prior art. Also, a cooling and emission gas exhaust control system is provided with the rotary valve of this invention. In particular, the surface of the rotary valve which faces the combustion chamber is cooled which prevents warping of the rotary valve.

In addition, the throttle control for the rotary valve has an adjustable throttle plate which effectively changes the size of the intake port opening to compensate for differences in engine speed. The throttle plate control provides better performance at all speeds from idle to wide open throttle. Thus, the complete rotary valve system of this invention overcomes the problems of the prior art and further advances the art of rotary valve operation in internal combustion engines.

More specifically, one important aspect of this invention lies in providing an improved mechanism for regulating the flow of intake gases into the rotary valve. The intake system regulates the amount of intake gases that can flow into the rotary valve body so that such intake gases do not build up a high pressure within the valve body as in prior art systems.

Briefly, the rotary valve and intake regulation system of this invention comprises a rotary valve including a generally elongated valve body having first and second ends and a longitudinally extending axis of rotation. The valve body includes a generally cylindrical wall which defines radially-spaced intake and exhaust ports. Intake and exhaust passageway means are provided within the rotary valve for providing passages between the first end of the body and the intake port and the second end of the body and the exhaust port. The intake regulation system generally includes a secondary intake port on the first end of the body on the fresh air side to harmonize the air flow inside the valve body and to eliminate irregular or erratic fluctuations behind the main intake port. The secondary intake port is preferably larger than the main intake port to enable the flow of more air into the main intake port. This prevents choking the main intake port of proper air flow. For example, the secondary intake port opens to the fresh air intake before the main intake port opens to the combustion chamber and also closes at about the same time that the main intake port closes to the combustion chamber. An advantage of such a design of the secondary intake port is to maintain even pressures within the valve body and to use wave-like motion instead of digital motion which is created by opening and closing the intake port.

A further aspect of this invention lies in providing a semi-direct fuel injection system. A solenoid controlled fuel injector is provided to directly supply fuel to the combustion chamber at regulated intervals coordinated with the position of the intake port of the rotary valve. The semi-direct fuel injection system in combination with the rotary valve incorporates a regular solenoid-controlled injector in the engine head which opens to the surface where the side and corner seals of the valve body slide over. When the injector is not covered by the valve body during the intake stroke, fuel is injected by the injector into the combustion chamber directly. The vacuum created by the piston being drawn down further atomizes the fuel.

As will be described below, the fuel injector starts injecting fuel into the combustion chamber as soon as overlap is finished which is approximately 30 degrees after top dead center. The overlap referred to results from a portion of the intake port being positioned over the combustion chamber at the same time a portion of the exhaust port is positioned over the combustion chamber. Thus, there is a partial overlap when both the intake port and the exhaust port are over the combustion chamber. Depending on the timing of the intake port closing, the fuel injector will stop injecting fuel. At idle, the fuel injector stops injecting fuel at bottom dead center, whereas at high speeds, the fuel injection stops at a later time. In an embodiment, the fuel injector is advantageously hidden behind the gas seals. This hiding of the fuel injector from the explosion of the combustion chamber and the temperatures of the chamber will increase the life of the injector.

Using this feature a regular solenoid controlled fuel injector can be added to the engine head. The fuel injector opens to the surface where the side and corner seals slide over. Semi-direct fuel injection is thus possible using the rotary valve of the present invention. The rotary valve of the present invention provides for a simple port fuel injection as direct fuel injection. In addition, atomized fuel is exposed to only two phases of pressure instead of three as in present systems discussed above. When the fuel injector is not covered by the rotary valve body during the intake stroke, fuel is injected into the combustion chamber directly into the vacuum created by the piston which atomizes the fuel even further. During compression, some of the fuel particles merge. Since the atomized fuel is not exposed to the manifold phase, the resulting particles are at least as small as the fuel provided by direct fuel injection systems.

Another important aspect of this invention lies in providing an improved sealing system for a rotary valve which efficiently and effectively seals the rotary valve in the longitudinal and radial directions. The sealing system is mounted entirely upon the rotary valve so that varying movement of the rotary valve within the cylinder head does not affect the alignment of the sealing elements. Providing the sealing system on the rotary valve also allows the rotary valve to self-adjust to the best position within the valve housing. In operation, the sealing elements mounted on the rotary valve dynamically change position depending upon the stage of the combustion cycle to provide the most effective sealing arrangement for the particular stage of the cycle. For example, during the combustion stage, the seals are designed so that the compression and combustion pressures cause the sealing elements to move and form a tight seal between the rotary valve and the valve housing and around the intake and exhaust ports. During the intake phase when gas pressures are under vacuum, the sealing elements loosen up and allow lubrication to flow between the sealing elements and the valve housing.

The sealing system of this invention generally is composed of receiving means provided in the cylindrical radial sidewalls of the rotary valve for receiving a plurality of sealing elements. The receiving means include a first plurality of arcuate grooves in one sidewall adjacent to one side of the intake and exhaust ports and a second plurality of arcuate grooves in the opposite sidewall adjacent to the other side of the intake and exhaust ports. The arcuate grooves are provided for receiving sealing elements which seal the rotary valve within the valve housing. The receiving means also includes first and second axial channels which extend in the longitudinal direction adjacent to the outer axial edges of the intake and exhaust ports. The receiving means may also include a third axial channel defined by an inner wall segment between the inner edges of the intake and exhaust ports.

Axial seal means are provided in the first and second axial channels for sealing the rotary valve within a cylinder head in the radial direction. The axial seal means may take the form of first and second sliding seals disposed within the first and second axial channels. Lifting means may be interposed between the first and second axial seals and the first and second axial channels for urging the sliding seals radially outward. The first and second sliding seals are shorter than the distance between the first and second plurality of arcuate grooves so that they have room to expand during elevated operating temperatures of the engine.

Side seal means are also provided in the accurate grooves of the valve for sealing the valve in the longitudinal direction. Leaf springs are preferably positioned beneath the side seals for causing a tight seal between the side seals in the engine head.

In order to provide a seal between the side seals and the axial sliding seals, the cylindrical wall defines cavities adjacent the ends of the axial channels for receiving corner seal means for sealing the gap between the side and axial seals. The corner seals are movable within the cavities. During the combustion phase, the pressurized combustion gases force the corner seals outward to form a tight seal between the side and axial seals. The outward movement of the corner seals also helps to force the side seals outward to form a tight longitudinal seal with the engine head. The corner seals may have a generally cylindrical outer shape while having a U-shaped cross-section for engaging the axial seal.

The cylindrical wall of the rotary valve also includes a divider seal means for sealing between the intake and exhaust ports. In one embodiment, the divider seal means take the form of an axial channel between the inner edges of the intake and exhaust ports, a divider seal member disposed in the axial channel, and a leaf spring interposed between the divider seal member and the axial channel for urging the divider seal radially outward. In an alternate embodiment, the divider seal means may include two divider seal members provided on the inner wall segment between the inner edges of the intake and exhaust ports.

In operation, the sealing elements form a gas-tight seal during the compression and combustion stage to prevent any compressed gas and unburned mixture from escaping the combustion chamber whereas the sealing elements loosen up during the intake stage to allow lubrication to enter the junction between the sealing elements and the valve housing.

During the compression and combustion stage, the outer wall segment between the outer edges of the intake and exhaust port is over the combustion chamber, and the combustion and compression gases flow over that outer wall segment and push the corner seals outward to seal the gap between the axial and side seals and also to help drive the side seals elements outward against the end wall of the arcuate grooves. In addition, the compression and combustion gases cause the sliding seals to move radially outward on the lifting means to form a tight seal against the interior valve housing.

During the intake phase, the sealing elements all move or relax to allow lubrication to enter the juncture between the sealing elements and the valve housing. In particular, the sliding seals move on the lifting means radially inward to provide a lubrication gap between the sliding seals and the valve housing. The corner seals and the side seals also move inward towards the intake and exhaust ports due to the negative pressure exerted by the combustion chamber during the intake stage.

Yet another important aspect of the present invention lies in providing a cooling and reduced emissions system for the rotary valve. Significantly, the cooling system provides the advantage of cooling the rotary valve and also reduces the amount of unburned fuel in the emissions from the engine through the rotary valve.

The cooling and emission system of this invention generally is composed of an air pump (electrical or mechanical) connected via a fresh air inlet to a port arranged in the valve body. The port in the valve body is arranged at the exhaust side, that side being nearest the exhaust manifold. The cooler air enters from the fresh air inlet at the exhaust side of the valve body and is forced between an outer wall and an inner wall of the rotary valve body. The outer wall is that portion that is directly exposed to the extremely high temperatures of the combustion chamber. However, the inner wall is also exposed to expelled exhaust gases.

The inner wall is obviously located inside the outer wall and may have a barrier separating the two walls. The cooler fresh air passes into the valve body such that it comes into contact with the inner wall and passes around the barrier to exit the rotary valve. The cooler fresh air reaches the chamber between the intake and exhaust ports to cool this area. In particular, the surface of the rotary valve which faces the combustion chamber is cooled. This is important since this is the surface exposed to extremely high combustion temperatures.

The air is thus used as a coolant and can be separately discharged or can be used in combination with exhaust injection. In another embodiment, the inner wall is constructed to provide and form an internal channel within the valve body. The internal channel has a opening within the valve body directed toward the exhaust side through which the coolant air is expelled into the exhaust stream. This promotes complete burning of the fuel in the exhaust stream by adding fresh air (oxygen) to the exhaust gases.

On cars lacking an air pump, there is no oxygen inside the exhaust system. Therefore, unburned fuel coming out of the combustion chamber cannot continue to burn. Consequently, unburned gas ends up flowing through the tail pipe as additional emissions. This situation is undesirable from an environmental and fuel conservation stand point. However, the cooling and emissions system of the present invention reduces these emissions.

In an embodiment, the rate of the coolant air can be controlled according to the engine's speed and the load. In particular, the cooling and emissions system of the present invention also includes a thermoswitch which senses a temperature at which there is no need for the cooling air injection. In an embodiment, this thermoswitch is connected to a control system which disables the air injection at temperatures below 45° C. Below 45° C., the mixture in the exhaust manifold is too rich, so there is no need for the air injection.

In an embodiment, the rotary valve may include a bifurcated or two-part valve body formed from a separate intake and exhaust housing. The separate intake and exhaust housings can be formed by milling or hydroforming and can be connected together to form a unitary valve body. The separate intake and exhaust housings advantageously include separate intake and exhaust passages defined by tubes that are spaced apart to reduce direct heat transfer between the intake and exhaust passages. Generally, internal combustion engines operate more efficiently with cooler intake gases, and preventing or reducing direct heat transfer between the exhaust passage and intake passage thus improves efficiency and performance of the internal combustion engine.

Yet another important aspect of the present invention lies in providing a throttle control for the rotary valve. The throttle control for the rotary valve generally comprises an adjustable throttle plate located behind the intake port and provides full control of the intake port timing. The sliding throttle plate is connected to the throttle. The sliding throttle plate apparatus on the rotary valve of the present invention will atomize fuel to a greater extent than a poppet valve engine having fuel injection. It also eliminates the need for an external intake manifold as explained below.

In contrast, on a typical poppet valve engine having a port or a throttle injection system, the air fuel mixture is exposed to periodic velocities which are created by intake valve openings and closings. There are also three pressure phases. The first pressure phase occurs when the intake valve closes. The rushing air comes to a halt and creates higher pressures than the atmospheric pressures. Under this pressure, the atomized fuel merges together to create larger fuel particles. These larger fuel particles require longer burning time and, as a result, some do not burn completely during the combustion cycle. The unburned fuel will be expelled with the exhaust, thus raising the exhaust emissions. The throttle control system of this invention avoids such problems.

In operation, the throttle plate of the present invention is almost closed over the intake port at idle rpm. Thus, if the rotary valve of the present invention is used with a carburetor, overlap between the intake and exhaust ports can be completely eliminated, which prevents raw fuel from escaping in the exhaust. At higher engine speeds, the sliding throttle plate is retracted so that the fuel intake port is open. This adjustability improves performance at all operating engine speeds.

Other objects, features and advantages will become apparent from the following description and drawings.

BRIEF DESCRIPTION OF THE DRAWINGS

FIGS. 11*a*–11*c* are somewhat schematic cut-away side views of an embodiment of a valve housing of the present invention including a fuel injector illustrating the relative position of the fuel injector with respect to the intake port of the rotary valve during operation.

FIG. 13 is a somewhat schematic perspective view of an embodiment of a sliding throttle plate located within the valve body of the rotary valve of the present invention.

FIG. 14 is a cross-sectional view taken along section line XIV—XIV of FIG. 13 of the sliding throttle plate of the present invention.

FIG. 15 is a top view of the various positions of the sliding throttle plate relative to the intake port illustrated in FIG. 14 of the present invention.

FIGS. 16*a*–16*c* are somewhat schematic views illustrating the position of the secondary intake port and the main intake port relative to the combustion chamber during operation of the rotary valve of the present invention.

DETAILED DESCRIPTION OF THE PREFERRED EMBODIMENTS

Figure 1:
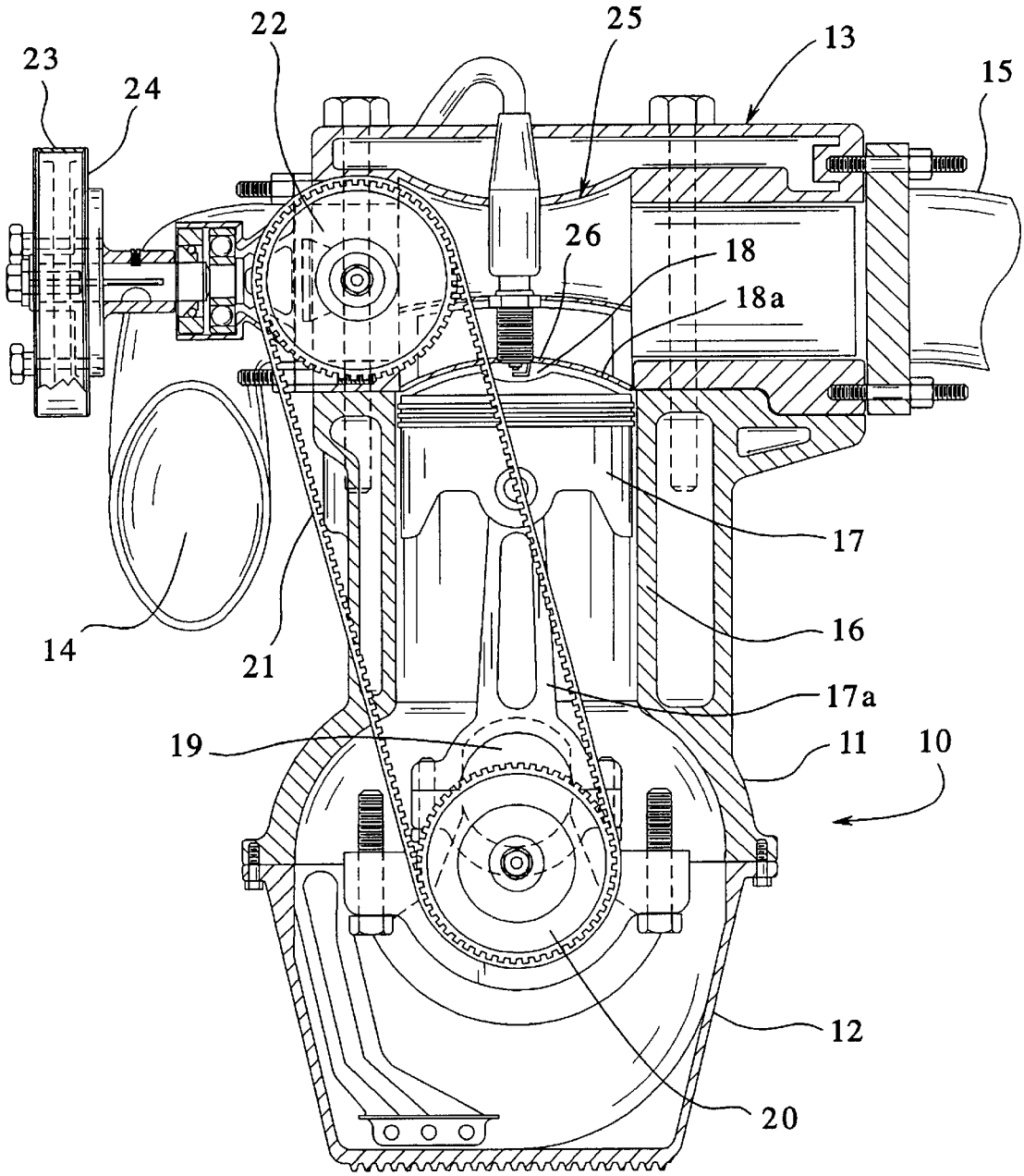
FIG. 1 is a partially cut-away perspective view of an internal combustion engine including an embodiment of a rotary valve of the present invention.

Referring to FIG. 1, the numeral 10 generally designates an internal combustion engine having an engine block 11, an oil pan 12, a cylinder head 13, an intake pipe 14 and exhaust pipe 15. The engine 10 also includes a cylinder 16 which receives a reciprocating piston 17 having a connecting rod 17*a*. The piston 17 travels within the cylinder 16 in a combustion chamber 18. Of course, a plurality of cylinders 16 are possible in the engine block 11. Except as herein described, many of the components of the internal combustion engine 10 may be of conventional design and utility.

The piston 17 is connected via the connecting rod 17*a* to a crank shaft 19. The crank shaft 19 turns a drive pulley 20. A belt 21 connects the drive pulley 20 to a valve train pulley 22. A timing belt 23 encircles a valve train gear 24. The pulley and belt components combine to form a valve train drive system that operates similarly to that of the drive system described in co-owned U.S. Pat. No. 5,490,485 for a "Rotary Valve for Internal Combustion Engine," which is hereby incorporated by reference. Selection of gear ratios and belt lengths of the components of the valve train drive system may be varied to effectively time the rotation of a plurality of rotary valves 25.

Figure 2:
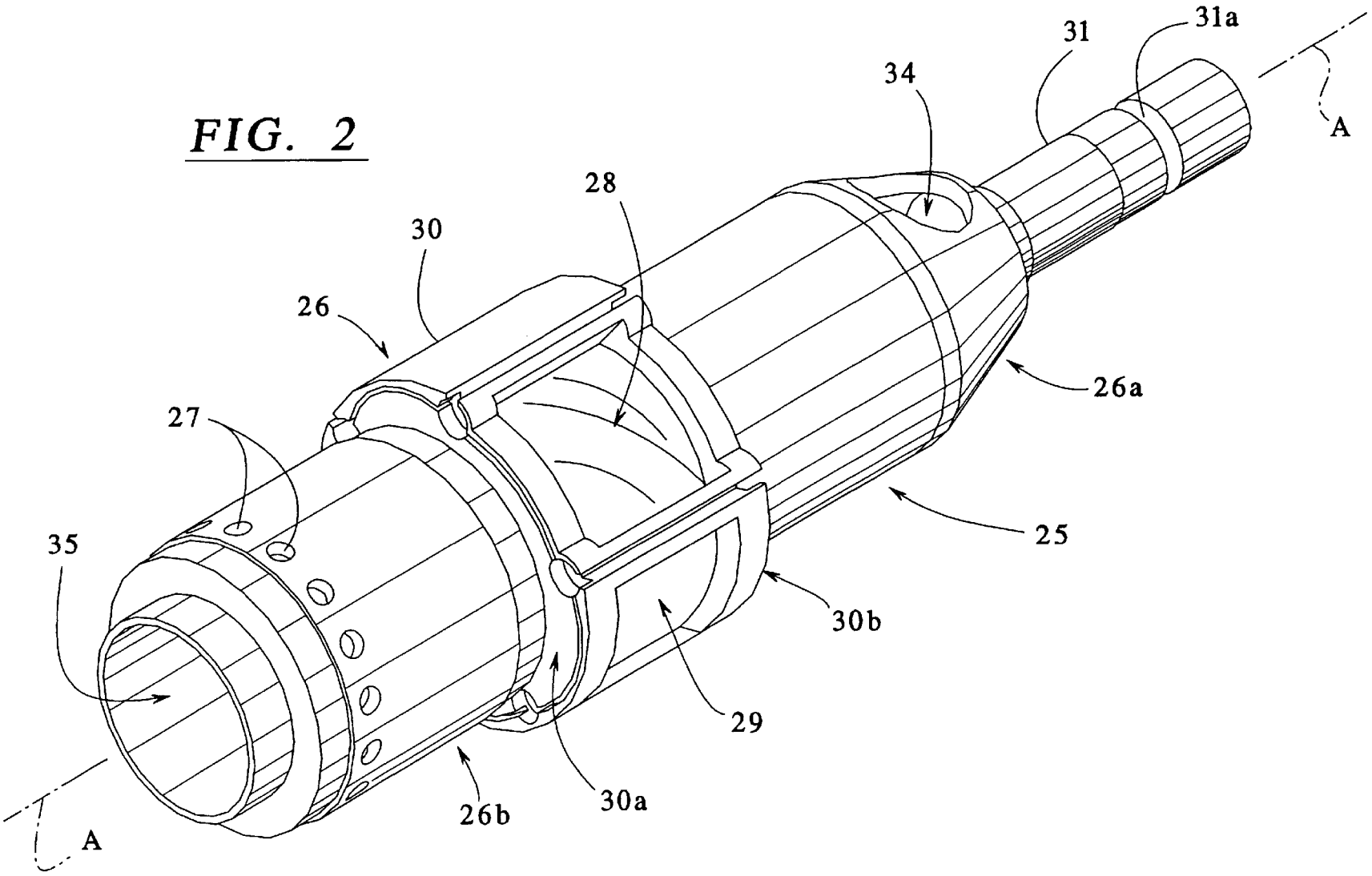
FIG. 2 is a perspective of an embodiment of a rotary valve of the present invention illustrating the secondary port at the intake side of the valve body.
Figure 3:
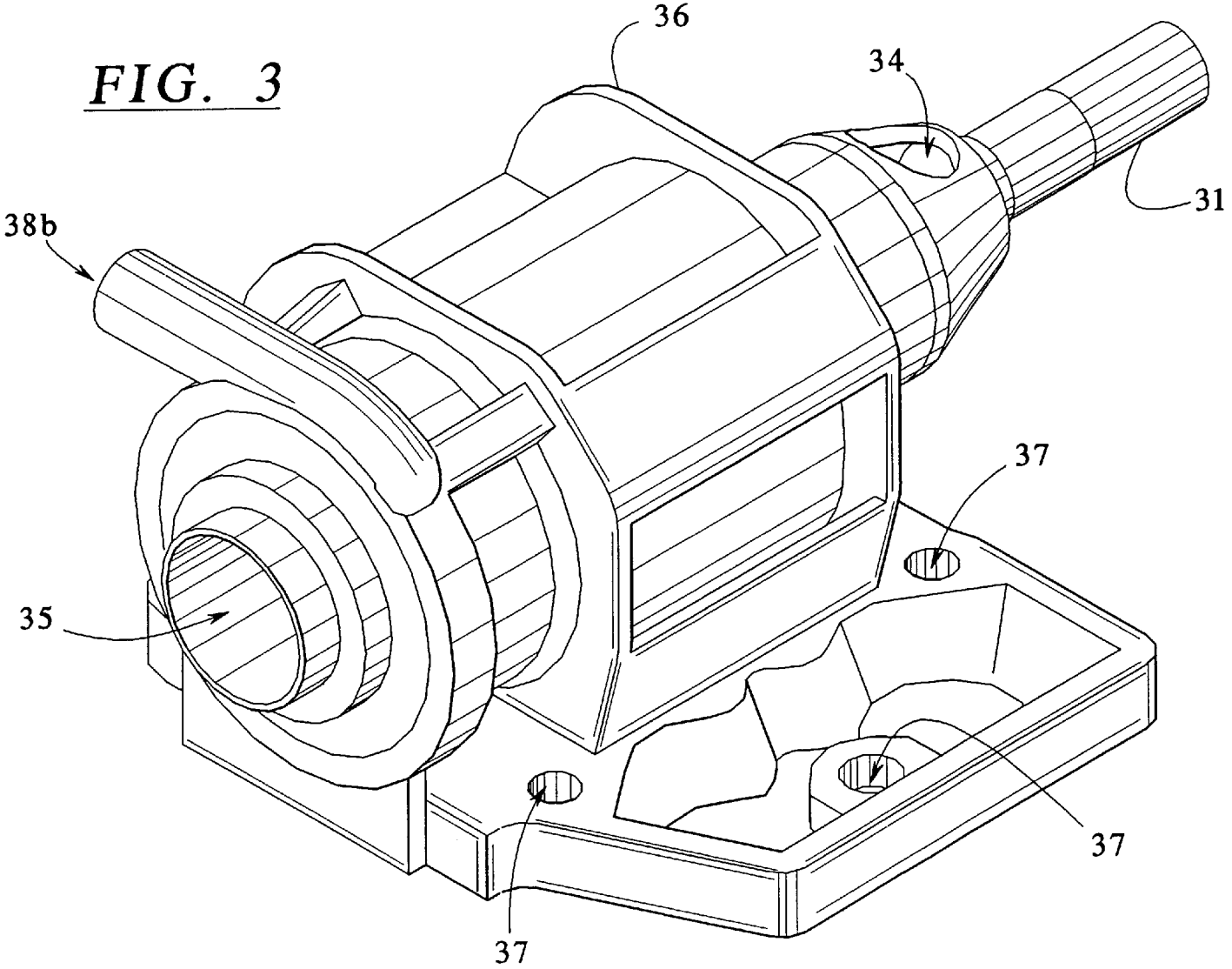
FIG. 3 illustrates a perspective view of an embodiment of a rotary valve arranged in a housing to be mounted to a cylinder head above a combustion chamber of an internal combustion engine.
Figures 4, 5:
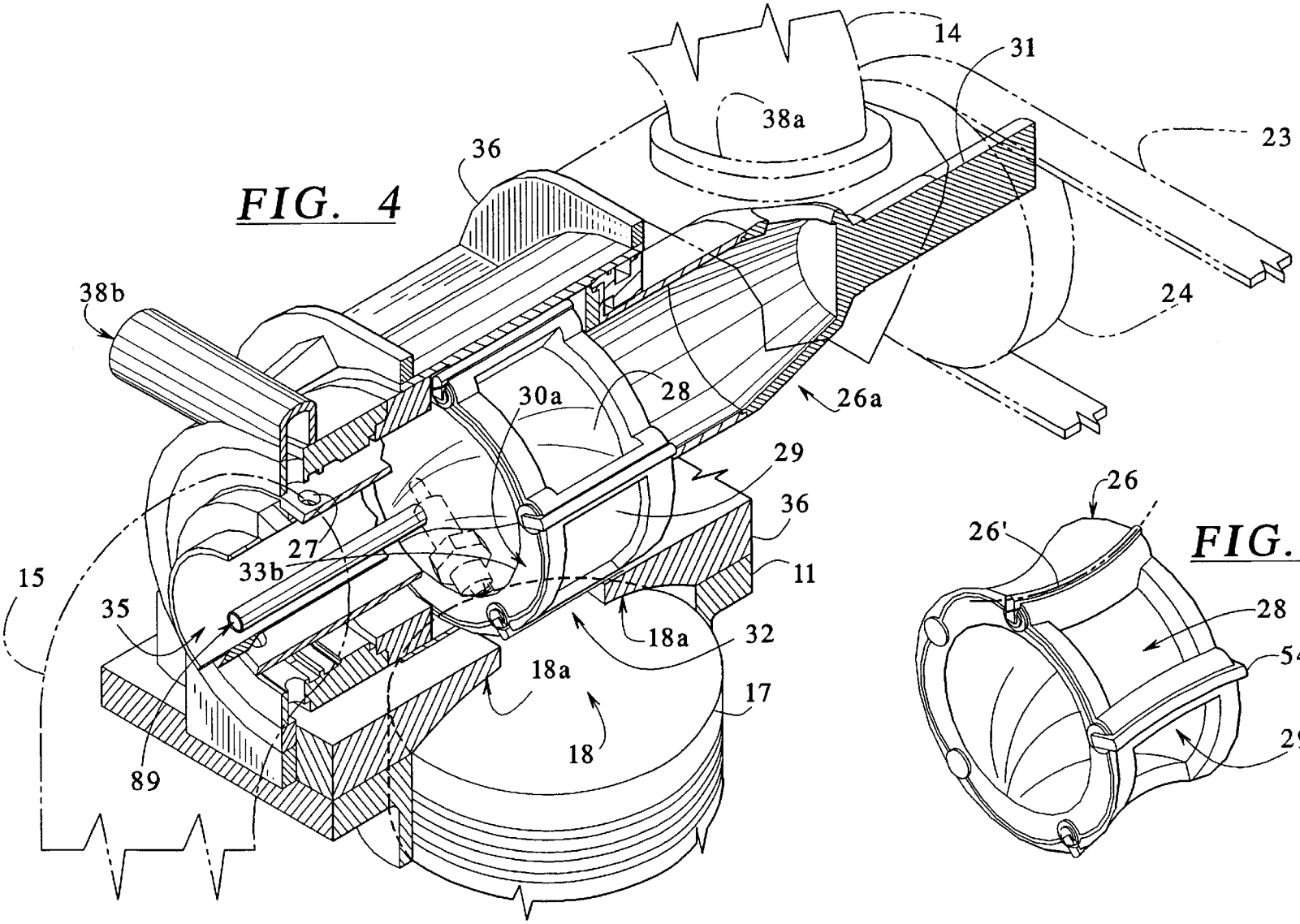
FIG. 4 is a perspective view in partial cross-section of the embodiment of the rotary valve of FIG. 3 mounted to an internal combustion engine.
FIG. 5 is a perspective view of an alternate embodiment of a valve body of the rotary valve of the present invention.

The rotary valve 25 of this invention is illustrated more completely in FIGS. 2, 3 and 4. As illustrated in FIG. 2, rotary valve 25 includes a relatively elongated valve body 26 having a first end 26*a*, a second end 26*b*, and a longitudinally extending axis of rotation A. A plurality of cooling ports are provided in the second end 26*b* of the rotary valve 25. The operation of the ports 27 is explained below with reference to FIGS. 9 and 10.

The valve body 26 also includes an intake port 28 and an exhaust port 29 defined by an outer wall 30. The intake and exhaust ports 28 and 29 are radially spaced on the valve body 26. The valve body 26 also includes a first radial sidewall 30*a* and a corresponding second radial sidewall 30*b*. A drive shaft 31 is provided on the first end 26*a* of valve body 26 for rotating the rotary valve 25 so that the intake and exhaust ports 28 and 29 periodically communicate with a head port 32 (see FIG. 4) in the cylinder head 13 which leads to the combustion chamber 18 as shown in FIG. 1 and FIG. 4. The drive shaft 31 includes a shear point 31*a* which is designed to break the shaft if the rotary valve seizes. This avoids stripping of the timing bolt or stoppage of other rotary valves if one valve breaks down. Accordingly, the remaining cylinders can continue to run which could be important in airplane and boat applications.

Referring to FIG. 4, the rotary valve 25 provides an intake passage 33*a* between a secondary intake port 34 at the first end 26*a* of the body 26 and the intake port 28. Similarly, the rotary valve 25 provides an exhaust passage 33*b* between an exhaust opening 35 at the second end 26*b* of the body 26 and the exhaust port 29. Referring to FIG. 3, the rotary valve 25 is disposed in a rotary valve housing 36. The housing 36 includes mounting holes 37 for connecting the engine head 13 to the engine block 11. The housing 36 also includes an inflow port 38*a* and an air inlet 38*b*.

FIG. 4, in partial cut-away, more completely illustrates the rotary valve 25 of the present invention and its surrounding environment. The intake pipe 14 is connected to the cylinder head 13 for communication with the secondary intake port 34, and the exhaust pipe 15 is connected for communication with the exhaust opening 35. Also illustrated is the connection between the drive shaft 31 of the rotary valve 25 and the valve train gear 24 and the timing belt 23. The housing 36 is also connected as shown in FIG. 4, so that the rotary valve 25 is arranged directly over the combustion chamber 18 and the piston 17.

FIG. 5 illustrates an alternative embodiment of the valve body 26 of the rotary valve 25 of the present invention. As illustrated, this embodiment has a curvature 26' to the valve body 26 which corresponds to a curvature 18*a* of the combustion chamber 18. Matching the curvature of the valve body 26 to that of the combustion chamber 18 improves the overall performance of the rotary valve 25 and provides a better seal between the two. It also provides a perfect hemispheric shape which promotes more complete combustion. FIG. 1 also illustrates the arrangement of the curved valve body 26*a* relative to the curved shape of the combustion chamber 18 including the piston 17.

Figure 6:
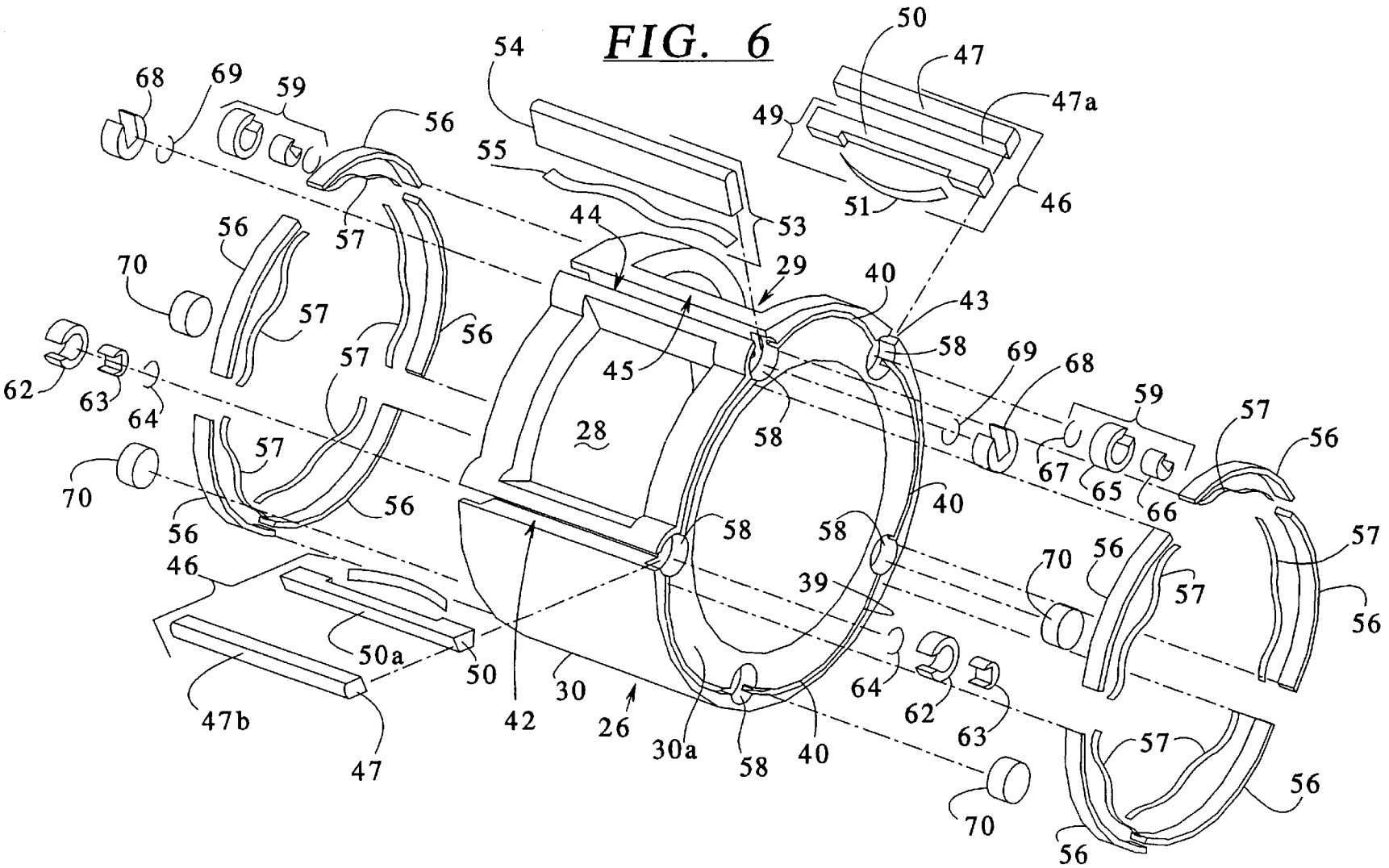
FIG. 6 is an exploded perspective view of an embodiment of the valve housing illustrating the sealing system of the present invention.

Referring to FIG. 6, the sealing system of this invention is illustrated which is generally comprised of two main components: (1) means for receiving sealing elements on the cylindrical wall of the rotary valve 25; and (2) a plurality of sealing elements which are disposed in the receiving means. The receiving means are generally positioned with respect to the intake and exhaust ports 28 and 29.

FIG. 6 illustrates, in an exploded view, the sealing system of the present invention, including the seals and the associated receiving means. Receiving means 39 are defined by the cylindrical radial sidewalls 30*a*, 30*b* of the valve body 26 for receiving a plurality of sealing elements. The receiving means 39 include a first plurality of arcuate grooves 40 in the valve body 26 in the first radial sidewall 30*a* adjacent to the intake and exhaust ports 28, 29 and a corresponding identical second plurality of arcuate grooves (not shown) in the other radial sidewall 30*b* of the valve body 26. The first and second plurality of arcuate grooves 40 are provided for receiving sealing elements which seal the rotary valve 25 within the valve housing 36. The following description refers primarily to the sealing of the first plurality of arcuate grooves 40. However, the sealing of the second plurality is identically arranged.

In an embodiment, the receiving means 39 includes an intake axial channel 42 which extends in the longitudinal direction adjacent to the outer axial edge of the intake port 28. A similar exhaust axial channel 43 extends in the longitudinal direction adjacent to the outer axial edge of the exhaust port 29. In an embodiment, the receiving means 39 also includes a divider axial channel 44 defined by an inner wall segment 45 between the inner edges of the intake and exhaust ports 28, 29.

Axial seal means 46 are provided in the intake and exhaust axial channels 42, 43 for sealing the rotary valve 25 within the cylinder head 13 in the radial direction. The axial seal means 46 may take the form of a sliding radius seal 47 disposed within both the intake and exhaust axial channels 42, 43. The sliding seals 47 are provided with an angled face 47*a* and a rounded face 47*b*. The sliding seals 47 are preferably shorter than the distance between the arcuate grooves 40 formed in the radial sidewalls 30*a*, 30*b* so that they have room to expand during elevated operating temperatures generated in the engine. The axial seal means 46 are similar for both the intake and exhaust ports 28, 29. Lifting means 49 may be interposed between the sliding radius seals 47 and the intake and exhaust axial channels 42,43 for urging the sliding radius seals 47 radially outward to create a better seal for the rotary valve 25. The lifting means 49 takes the form of a lifter seal 50 and a leaf spring 51. The lifter seal 50 also has an angled face 50*a* to cooperate with the angled face 47*a* of the sliding radius seal 47. The operation of the axial seal means 46 is described further below.

The cylindrical outer wall 30 of the rotary valve body 26 also includes a divider seal means 53 for sealing between the intake and exhaust ports 28, 29. In one embodiment, the divider seal means 53 includes within the divider axial channel 44 between the inner edges of the intake and exhaust ports 28, 29, a divider seal member 54 disposed in the divider axial channel 44 and a leaf spring 55 interposed between the divider seal member 54 and the axial channel 44 for urging the divider seal 54 radially outward. In an alternate embodiment, the divider seal means 53 may include two divider seal members (not shown).

In addition, the alternative valve body 26 shown in FIG. 5 includes a divider seal member 54' having an arched edge to conform to the curvature 18*a* of the combustion chamber 18. The divider seal means 53 separates the intake port 28 from the exhaust port 29 to prevent any gas migration between these ports. As a result, exhaust emissions are lowered. The divider seal means 53 fits within the divider axial channel 44 such that the divider leaf spring 55 is captured in the divider axial channel 44 by the divider seal member 54. The divider leaf spring 55 urges the divider seal member 54 radially outward. This causes a tight seal to be developed between the divider seal member 54 and the inner wall surface of the head port 32.

Again referring to FIG. 6, the first plurality of arcuate grooves 40 is provided to receive an arcuate side seal 56 and leaf spring 57 within the arcuate grooves 40 in a plurality of locations. In order to provide a seal between the side seals and the axial sliding seals, the radial sidewalls 30*a*, 30*b* include cavities 58 adjacent the ends of the axial channels 42,43 for receiving corner seal means 59 for sealing the gap between the arcuate side seals 56 and the axial seals 46, 53. The same sealing arrangement is provided on both sides of the valve body 26. Thus, the reference numerals represent parts that are identical. It will understood that this side sealing means may comprise varying numbers of such arcuate side seals 56 around the circumference of the rotary valve side walls 30*a* and 30*b*.

To hold the axial seal means 46 in the axial channels 42, 43, all of the seals fit together with corner seal means 59. Specifically, an intake corner seal 62 having a rubber holding insert 63 and an intake coil spring 64 is provided. Similarly, an exhaust corner seal 65 having a rubber holding insert 66 and an exhaust coil spring 67 is also provided. Also, a divider corner seal 68 with a coil spring 69 is provided in the cavity 58 at the end of the divider seal means 53. Filler seals 70 are also provided in two of the cavities 58 to hold the arcuate side seals 56 and leaf springs 57 in the arcuate grooves 40 away from the intake and exhaust ports 28, 29.

The corner seals 62, 65 and 68 and the filler seals 70 are movable within the cavities 58. During the combustion phase, the pressurized combustion gases force the corner seal means 59 outward to form a tight seal between the arcuate and axial seals. The outward movement of the corner seals 62, 65 and 68 also helps to force the arcuate seals 56 outward to form a tight longitudinal seal within the first and second arcuate grooves 40. The corner seals 62, 64 and 68 may have a generally cylindrical outer shape while having a U-shaped cross-section for engaging the axial seal means 46.

Figure 8:
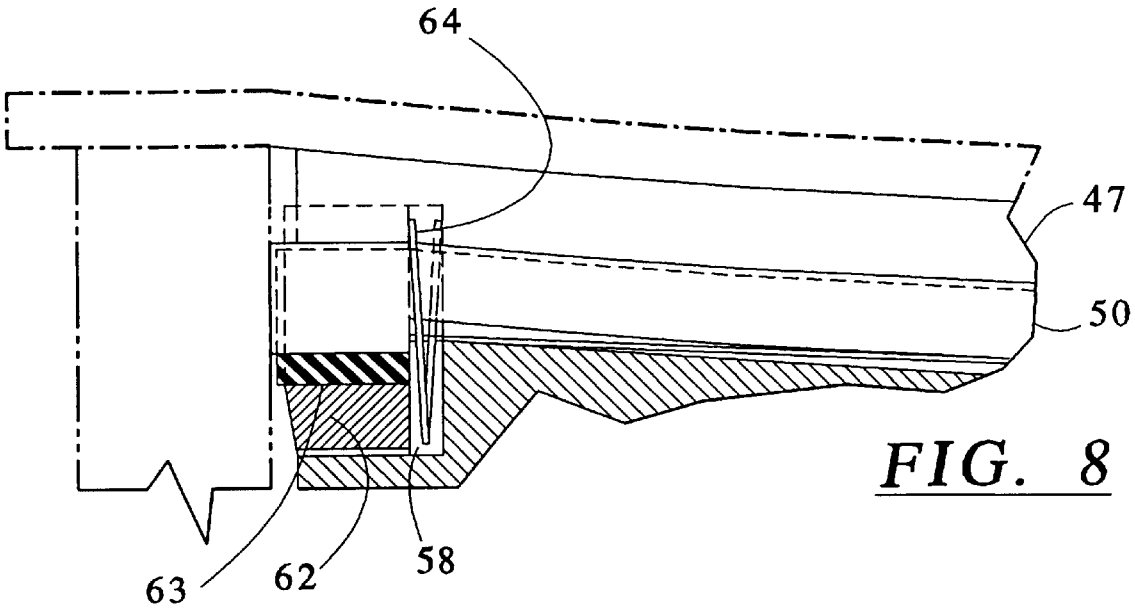
FIG. 8 is a detail side view of a portion of the sealing system of the present invention.
Figure 7:
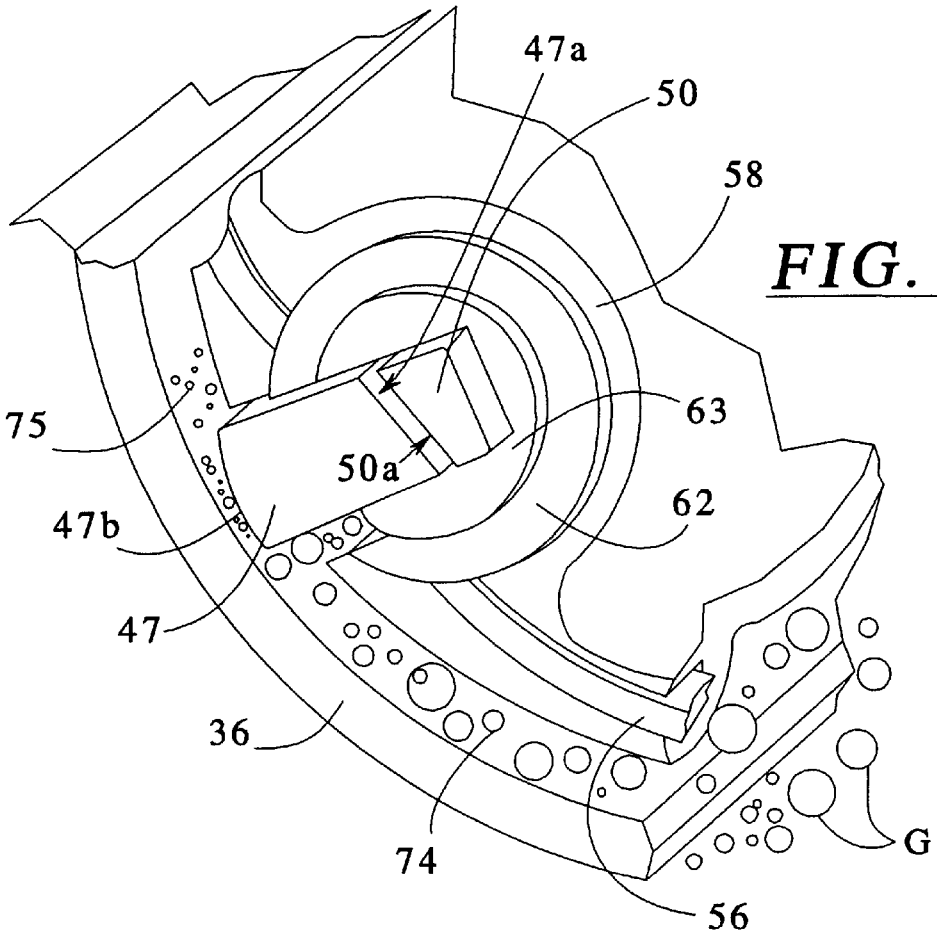
FIG. 7 is a detail perspective view of a portion of the sealing system of the present invention.

FIGS. 7 and 8 illustrate that in operation, the sealing elements form a gas-tight seal during the compression and combustion stage to prevent any compressed gas and unburned mixture from escaping the combustion chamber 18. In addition, the sealing elements advantageously loosen up during the intake stage to allow lubrication to enter the junction between the sealing elements and the valve housing 36.

In particular, during the compression and combustion stage, the outer wall segment between the outer edges of the intake and exhaust ports 28, 29 is over the combustion chamber 18, and the combustion and compression gases G flow over that outer wall segment and push the corner seals outward to seal the gap between the axial and arcuate side seals and also to help drive the arcuate seal elements outward against the end wall of the arcuate grooves 40 as shown in FIGS. 7 and 8. In addition, the compression and combustion gases cause the sliding radius seals 47 to move radially outward on the lifting means 49 to form a tight seal against the interior valve housing 36.

During the intake phase, the sealing elements all move or relax to allow lubrication to enter the juncture between the sealing elements and the valve housing 36. In particular, the sliding seals 47 move on the lifting means 49 radially inward to provide a lubrication gap between the sliding seals 47 and the valve housing 36. The corner seals and the arcuate side seals also move inward towards the intake and exhaust ports 28, 29 due to the negative pressure exerted by the combustion chamber 18 during the intake stage.

As shown in FIG. 7, the sliding radius seal 47 is designed to work with the lifter means 49. As shown in FIG. 7, the combustion gases 74 are under high pressure and, therefore, get underneath the seal to wedge the lifter seal 49 between the wall and the sliding radius seal 47. This pressurized gas 74 thus moves the rounded face 47*b* of the sliding radius seal 47 against a coated surface 75 to provide the essential sealing of the rotary valve 25. The sliding radius seal 47 also takes advantage of centripetal force. While the rotary valve 25 is rotating, the sliding radius seal 47 and lifters seal 49 will be forced away from the center of the valve body 26 to create a better seal against the coated surface 75. In addition, the lifter seal 49 can be heavier than the radius seal 47 to apply extra force to the radius seal 47.

As shown in FIG. 8, the seals fit together with the corner seal 62 within the cavity 58. The sliding radius seal 47 is positioned in the corner seal insert 63 which is approximately 0.1 mm wider than the radius seal 47 in an embodiment. FIG. 6 illustrates that the arcuate side seals 56 are within the arcuate grooves 40. In an embodiment, the arcuate side seals 56 are 0.1 mm short of touching the corner seals 62. However, under pressure the arcuate side seals 56 press against the corner seals 62, 65 to create complete sealing. Alternatively when the seals are not under pressure, they return to a relaxed position which allows lubricating oil to flow through the tolerances described above to areas where it is needed. FIG. 8 illustrates such tolerances.

The sealing system is thus designed to separate the intake port 28 and the exhaust port 29 from each other and from the combustion chamber 18 when necessary during the operation of the engine. The seals are also designed to move within the channels and grooves within certain pre-selected tolerances. Such movement facilities lubrication of the rotary valve 25 and advantageously improves sealing during cntical cycles of the engine operation.

Figure 9:
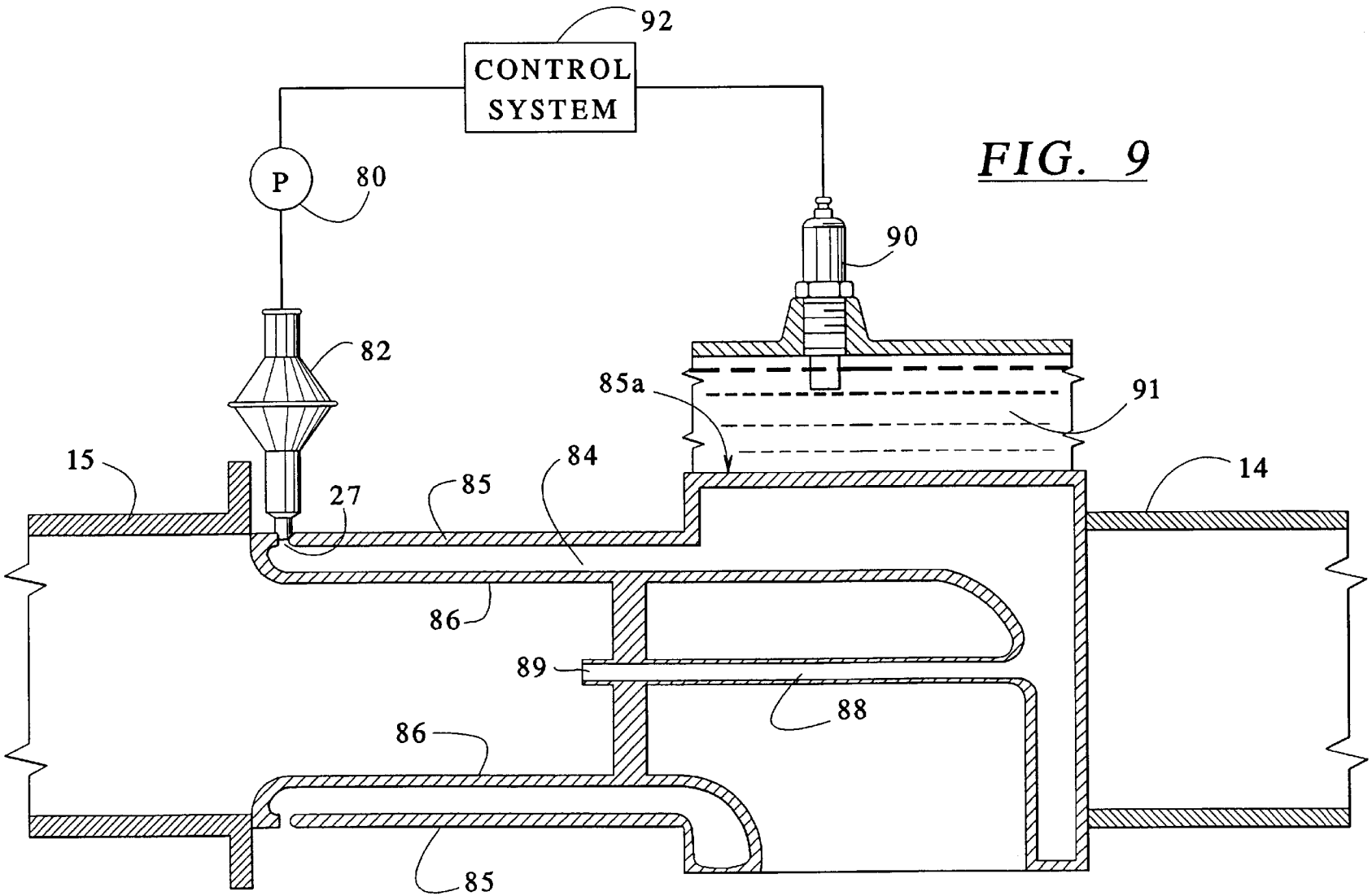
FIG. 9 is a somewhat schematic cut-away side view of an embodiment of the cooling and emission system of the rotary valve of the present invention.
Figure 10:
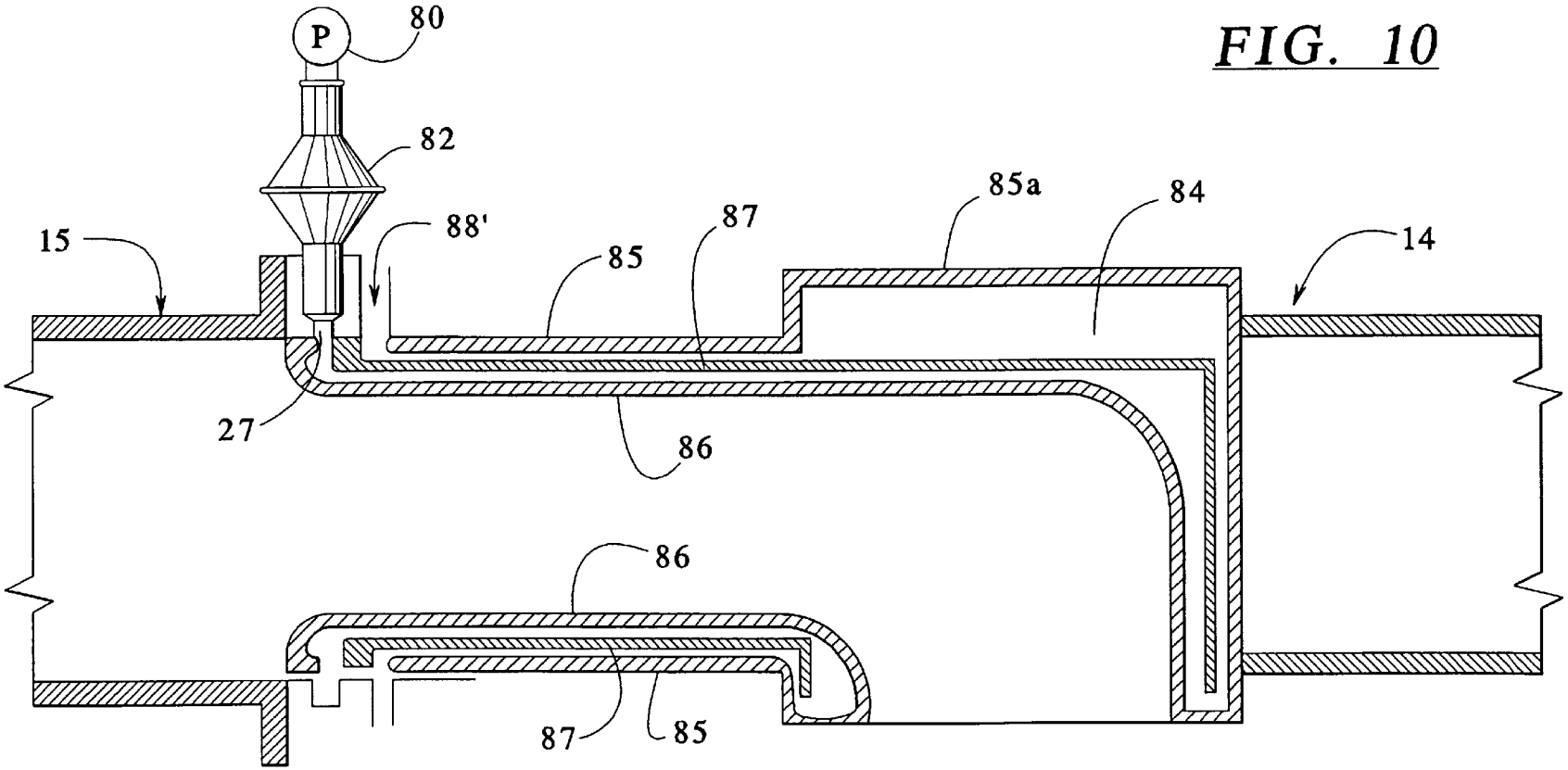
FIG. 10 is an another embodiment of the cooling and emission system of the rotary valve of the present invention.

FIGS. 9 and 10 illustrate the cooling and emission system of this invention. The cooling and reduced emissions system generally is composed of an air pump 80 (electrical or mechanical) connected via a fresh air inlet fitting 82 to the ports 27 arranged in the valve body 26. The ports 27 in the valve body 26 is arranged at the exhaust side, that side being nearest the exhaust pipe 15. The cooler air enters from the fresh air inlet fitting 82 at the exhaust side of the valve body 26. The air inlet fitting 82 preferably comprises a one-way check valve. The fresh air inlet fitting 82 is in communication with the air inlet 38*b* of the housing 36 shown in FIG. 4. The cooler air is forced through the plurality of cooling ports 27 into an area 84 between an outer wall 85 and an inner wall 86 of the rotary valve body 26. A section 85*a* of the outer wall 85 is that portion that is directly exposed to the extremely high temperatures of the combustion chamber 18. In the embodiment shown in FIG. 9, the inner wall 86 is constructed to provide and form an internal channel 88 within the valve body 26. The internal channel 88 has a opening 89 within the valve body 26 directed toward the exhaust side.

The inner wall 86 is obviously located inside the outer wall 85 and may have a barrier 87 separating the two walls 85, 86 as shown in FIG. 10. The cooler fresh air passes into the valve body 26 such that it comes into contact with the inner wall 86 and passes around the barrier 87 to exit the rotary valve 25 through an exit port 88' in FIG. 10. As a result, the warmed air is directly released to the exhaust away from the exhaust port 29. The cooler fresh air reaches the area between the intake and exhaust ports 28, 29 to cool this area. The inner wall 85 also acts as a heat sink to the exhaust gases.

In particular, the surface of the rotary valve 25 which faces the combustion chamber 18 is cooled. This is important since this is the surface exposed to extremely high combustion temperatures. The air is thus used as a coolant and can be separately discharged or can be used in combination with exhaust injection.

In the embodiment shown in FIG. 9, the rate of the coolant air can be controlled according to the engine's speed and the load. On cars lacking an air pump, there is no oxygen inside the exhaust system. Therefore, unburned fuel coming out of the combustion chamber cannot continue to burn. Consequently, unburned gas ends up flowing through the exhaust pipe 15 as additional emissions. This situation is undesirable from an environmental stand point. However, the cooling and emissions system of the present invention reduces these emissions.

The cooling and emissions system of the FIG. 9 also includes a thermo switch 90 which senses a temperature of coolant 91 at which there is no need for the cooling air injection. In the embodiment, this thermo switch 90 is also connected to a control system 92 which disables the air injection at temperatures below about 45° C. Below about 45° C., the mixture in the exhaust manifold is too rich, so there is no need for the air injection.

In order to facilitate construction of the rotary valve 25 with the foregoing cooling and emission system, the rotary valve 25 may be formed from a bifurcated or two-part valve body 226 illustrated in FIGS. 17–22. The bifurcated valve body 226 includes first and second ends 226*a* and 226*b*, an outer wall 230, and an intake port 228 and exhaust port 229. Generally, the bifurcated rotary valve body 226 is similar to valve body 26 except that the valve body 226 is formed from two separate but mateable intake and exhaust housings 231 and 232.

Intake housing 231 defines an intake passage 233*a* extending between the first end 226*a* of the valve body and the intake port 228. The intake passage 233*a* includes an intake tube portion 235 defining the intake port 228 and extending to the intake passage defined by the outer wall 230 of the intake housing 231. Similar to the intake housing 231, the exhaust housing 232 includes an exhaust passage 233*b* extending between the exhaust port 229 and the second end 226*b* of the valve body 226. The exhaust passage 233*b* includes an exhaust tube 236 defining the exhaust port 229 and communicating with the remainder of the exhaust housing 232.

In the embodiment shown in the drawings, the intake housing 231 is provided with a cap plate 237 and the exhaust housing 232 is provided with mid-housing 238. In use, the intake tube 235 is inserted into the mid-housing 238 of the exhaust housing such that the cap plate 237 seals off the enlarged mid-housing 238. To facilitate such connection of the intake housing 231 to the exhaust housing 232, the intake port 228 includes slanted side walls 239 and 240 that slide between and fit into receiving walls 241 and 242. Advantageously, the receiving walls 241 and 242 can form part of the receiving means for receiving axial seals about the intake port 228. In order to further facilitate such connection, the mid-housing 238 includes a lip 238*a* that fits within an outer lip or flange 237*a* of the cap plate 237. Once the intake housing 231 is fitted to the exhaust housing 232, the bifurcated components of the valve body 226 can be permanently sealed together by welding, crimping, gluing, or any other suitable connecting means.

Figure 18:
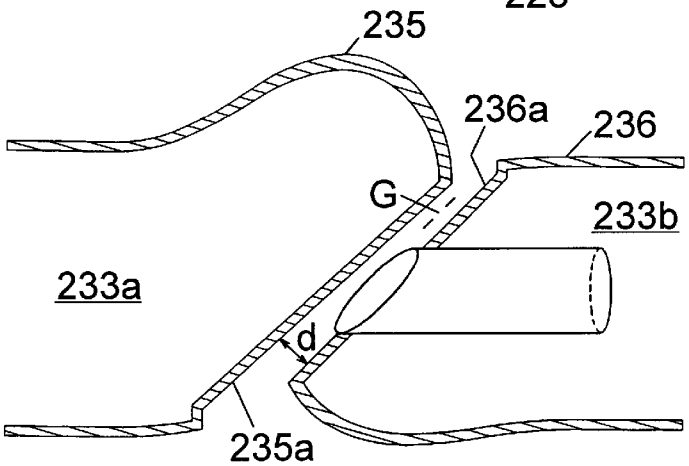
FIG. 18 is a somewhat schematic cross-sectional view illustrating the gap between the intake and exhaust passage tubes of the rotary valve shown in FIG. 17.

When the intake housing 231 and exhaust housing 232 are fitted together, the intake tube 235 and the exhaust tube 236 define a gap G therebetween as shown most clearly in FIG. 18. To provide this gap G, the intake tube and exhaust tube 235 and 236 respectively include a pair of flat parallel faces 235*a* and 236*a* that extend at an angle relative to the longitudinal axis of rotation of the rotary valve. The flat faces 235*a* and 236*a* are clearly shown in FIGS. 17 and 19, and the spacing between the faces is shown most clearly in FIG. 18. Preferably, the flat faces 235*a* and 236*a* form a gap G therebetween with a distance of between about ⅜ inches and ¼ inches. Such spacing prevents direct heat transfer between the exhaust tube 236 and the intake tube 235 so that hot exhaust gases flowing through the exhaust tube 236 do not rapidly heat the intake gases flowing through the intake tube 235. Importantly, internal combustion engines usually function better with cooler intake gases flowing through tube 235 and thus the separation and reduction of heat transfer between the exhaust tube 236 and the intake tube 235 results in improved engine performance.

The intake housing 231 and exhaust housing 232 are preferably formed of a metal material such as aluminum, stainless steel, or other suitable and known materials. In order to shape the intake and exhaust housings 231 and 232, as well as the intake tube 235 and the exhaust tube 236, conventional milling, hydroforming or other suitable processes can be used.

Figure 20:
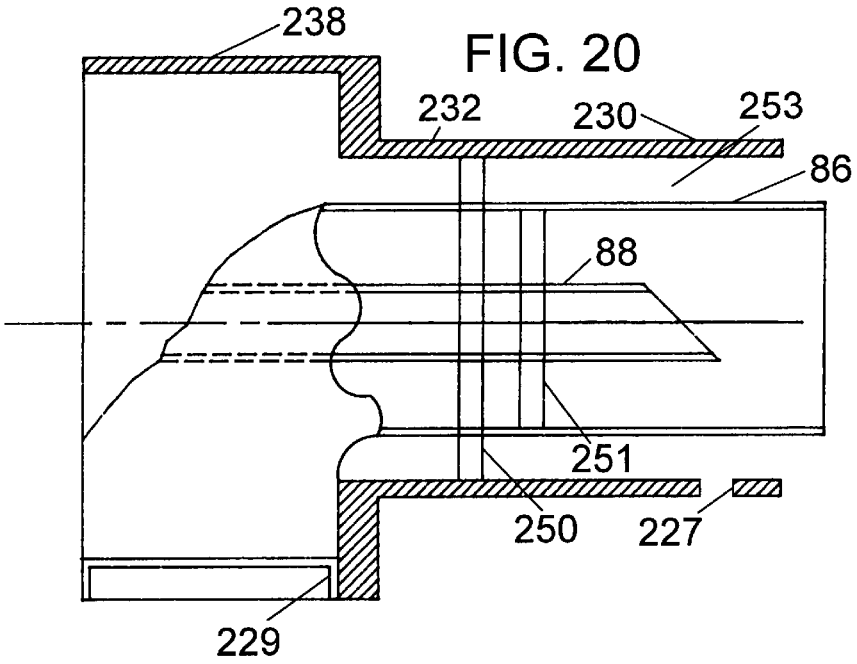
FIG. 20 is a somewhat schematic, cut-away side view of an embodiment of the exhaust housing of the valve body of the rotary valve shown in FIG. 17.
Figure 21:
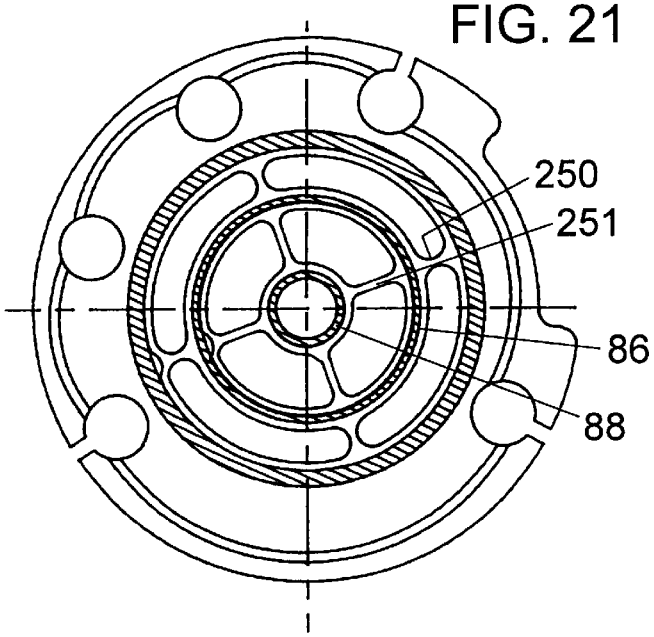
FIG. 21 is an end view of the exhaust housing of the valve body shown in FIG. 20.
Figure 22:
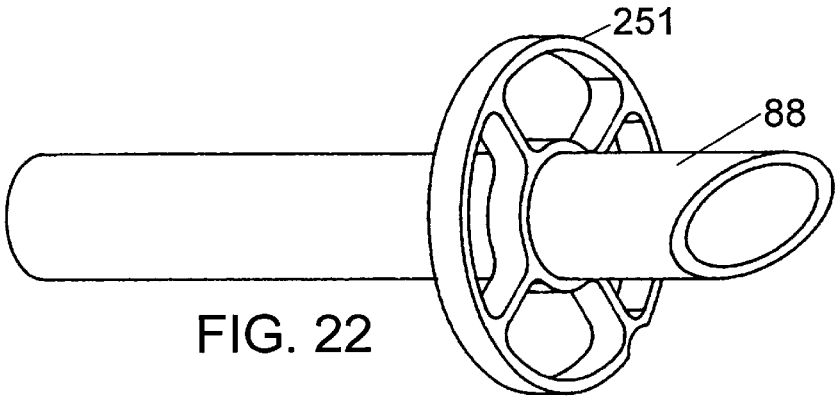
FIG. 22 is a perspective view of the tube and spacer ring of the exhaust passage of the rotary valve shown in FIG. 17.

The exhaust housing 232 is preferably provided with an inner tube 86 such as described in detail in connection with FIGS. 9 and 10. The inner tube 86 is spaced from the outer wall 230 of the exhaust housing 232 so that the inner tube 86 acts as a heat sink for the hot exhaust gases flowing therethrough to avoid heating and expansion of the outer wall 230, which could otherwise effect the performance of the rotary valve. Referring to FIGS. 20–22, a spacer ring 250 receives and supports the inner tube 86 within the outer wall 230 of the exhaust housing 232. As shown most clearly in FIG. 21, the spacer ring 250 has an open-frame structure to permit exhaust gases to flow therethrough while still providing a strong support for the inner tube 86.

The rotary valve 25 with the bifircated valve body 226 can most advantageously be used with the cooling and emission system of this invention described in connection with FIGS. 9 and 10. Briefly, the outer wall 230 defines one or more inlet ports 237 for permitting the circulation of cooling media in the chamber 253 between the inner tube 86 and the outer wall 230 of the exhaust housing 232. Significantly, circulation of cooling media or air through the chamber 253 also results in the circulation of cooling media through the gap G between the intake tube 235 and the exhaust tube and 236. Thus, in such a construction, the cooling system can be used to further prevent heat exchange between the intake and exhaust passages to improve the efficiency and performance of the internal combustion engine.

Figure 19:
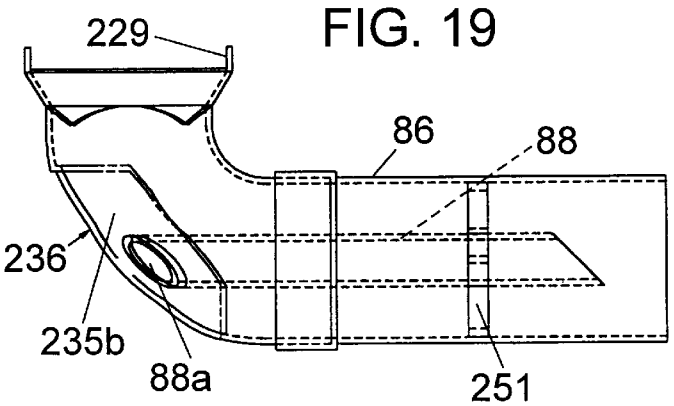
FIG. 19 is a side, somewhat schematic, partially broken away view illustrating the exhaust passage of the rotary valve shown in FIG. 17.

As previously discussed in connection with FIGS. 9 and 10, the inner tube 86 can also include a pitot tube 88. The pitot tube 88 can be positioned within inter tube 86 by another spacer ring 251 having an open-frame structure as shown most clearly in FIG. 21 to permit exhaust gases to flow therethrough. As shown in FIG. 19, the pitot tube 88 has an open 88*a* in communication with the space G and chamber 253 through which circulating media may be circulated by the cooling and emission system. In this manner, fresh air can be injected into the system so that the forms cooling functions in chamber 253 and in space G and then is exhausted through the pitot tube 88 to comingle with the exhaust gases flowing through the exhaust passage 233*b*. As previously discussed, this addition of fresh cooling air to the exhaust gases permits complete combustion of the exhaust gases to improve the efficiency of the internal combustion engine and to reduce pollutants that are emitted into the environment.

FIGS. 11*a*–11*c* illustrate an end view of an embodiment of the rotary valve 25 of the present invention. The rotary valve 25 of the present invention provides for a simple port fuel injection as direct fuel injection. In addition, atomized fuel is exposed to only two phases of pressure instead of three as in present systems discussed above.

Figure 12:
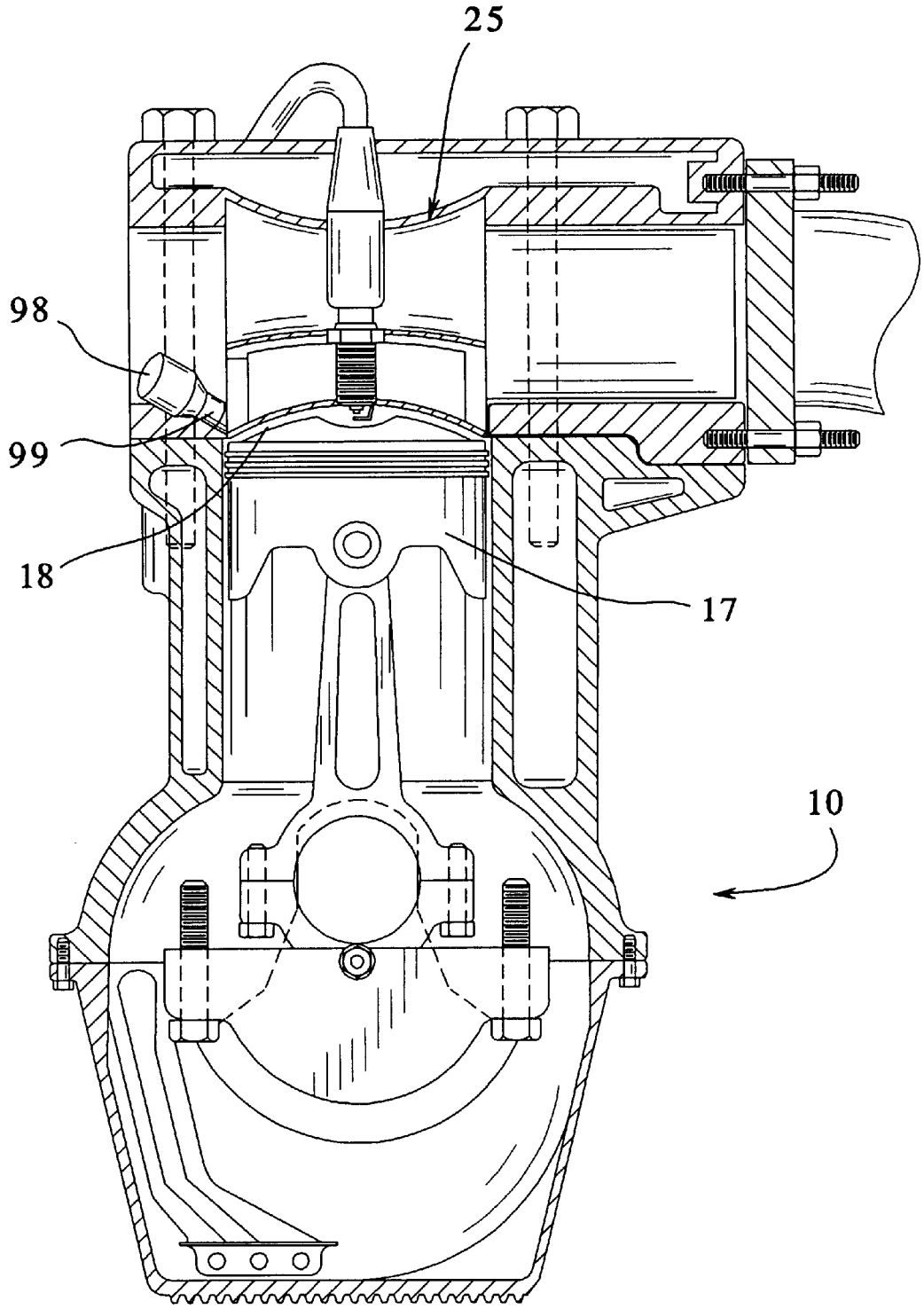
FIG. 12 is a cross-sectional view of an engine having the rotary valve of the present invention illustrating the placement of a fuel injector.
Figure 17:
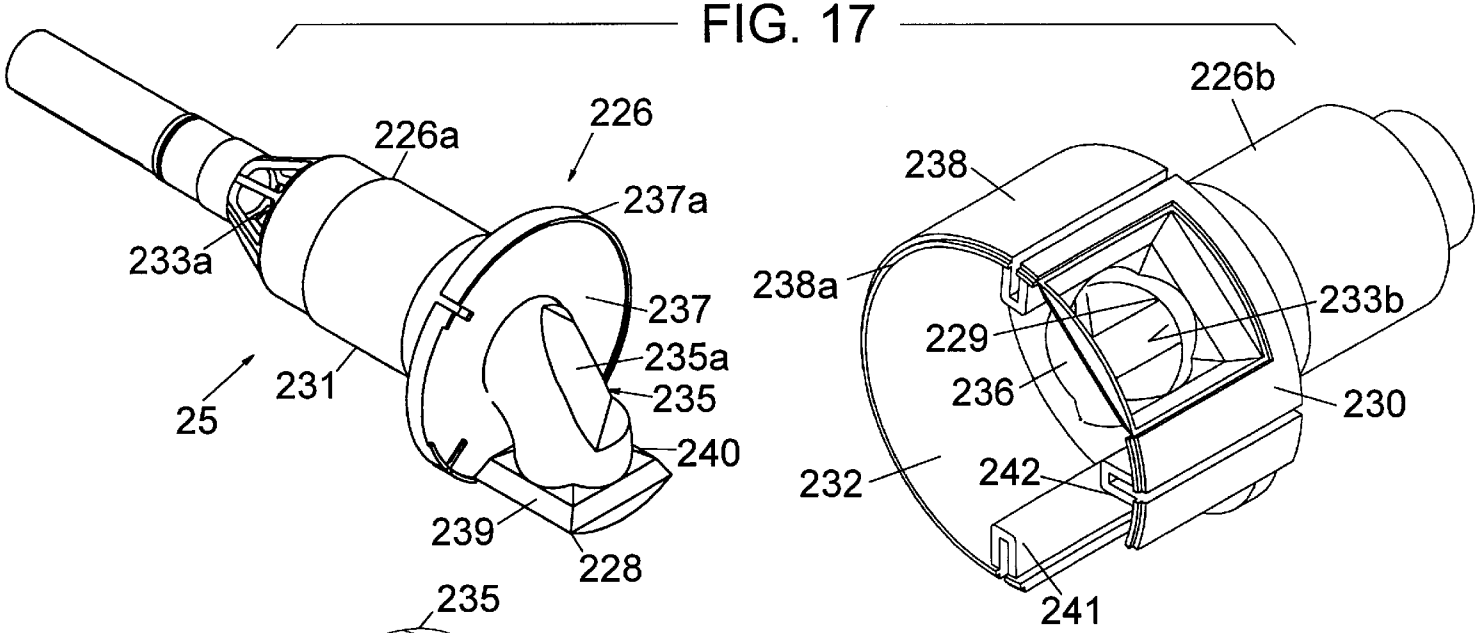
FIG. 17 is a somewhat schematic perspective view of one embodiment of a two-piece rotary valve of the present invention.

In a preferred embodiment of the present invention, the intake port 28 has lower side walls which are able to lubricate the side surfaces where the annular and corner seals are sliding over. Using this feature, a regular solenoid controlled fuel injector 98 can be added to the engine cylinder head 13. FIG. 12 illustrates the approximate location of the fuel injector 98 on the engine 10. The injector has a nozzle 99.

The fuel injector 98 opens to the surface where the side and corner seals slide over. Semi-direct fuel injection is thus possible using the rotary valve 25 of the present invention. The various seals are illustrated in FIGS. 11A–11*c* as well as the intake port 28. Rotation of the rotary valve 25 is indicated by the arrow labeled R.

When the fuel injector 98 is not covered by the rotary valve body 26 during the intake stroke, fuel is injected via the nozzle 99 into the combustion chamber 18 directly into the vacuum created by the piston 17 which atomizes the fuel even further. During compression, some of the fuel particles merge. Since the atomized fuel is not exposed to the manifold phase, the resulting particles are at least as small as the fuel provided by direct fuel injection systems.

As illustrated in FIG. 11*a*, the fuel injector 98 starts injecting fuel into the combustion chamber 18 as soon as the overlap is finished of the exhaust and intake valve timing. This is approximately 30 degrees after top dead center. FIG. 11*b* illustrates the relative position at which the fuel injector 98 stops injecting the fuel. The actual position depends on the intake port closing which is variable depending on the engine speed. At idle, this occurs at bottom dead center and at a high speed, the fuel injector 98 stops injecting fuel after bottom dead center. FIG. 11*c* also illustrates that the fuel injector 98 is somewhat hidden behind the seals. Hiding the injector 98 from the combustion explosion and also from the high temperature of the gasoline combustion will tend to increase the life of the injector 98.

Yet another important aspect of the present invention lies in providing a throttle control means 100 for the rotary valve 25 (see FIGS. 13–15). The throttle control means 100 for the rotary valve 25 generally comprises an adjustable throttle plate 102 located behind the intake port 28 and provides control of the intake port timing. The sliding throttle plate 102 is connected to a throttle actuator 104.

The sliding throttle plate 102 on the rotary valve 25 of the present invention will atomize fuel to a greater extent than a poppet valve engine having fuel injection. It also eliminates the need for an external intake manifold. In particular, since the rotary valve 25 of the present invention provides the throttle plate 102 on the opening of the intake port 28, the intake port 28 can be closed when the piston is at the bottom dead center position. By eliminating air discharge from the combustion chamber 18, there is no need for a large intake manifold collector. This eliminates or minimizes the intake manifold which advantageously lowers production cost and saves space and weight in the engine.

In addition, on a typical poppet valve engine having a port or a throttle injection system, the air fuel mixture is exposed to periodic velocities which are created by intake valve openings and closings. There are also three pressure phases. The first pressure phase occurs when the intake valve closes. The rushing air comes to a halt and creates higher than the atmospheric pressures. Under this pressure, the atomized fuel merges together to create larger fuel particles. These larger fuel particles require longer burning time and, as a result, some do not burn completely during the combustion cycle. The unburned fuel will be expelled with the exhaust, thus raising the exhaust emissions.

At idle rpm, the throttle plate 102 of the present invention is almost closed over the intake port 28. Thus if the rotary valve 25 of the present invention is used with a carburetor, overlap can be completely eliminated, which prevents raw fuel from escaping in the exhaust. At higher engine speeds, the sliding throttle plate 102 is retracted so that the fuel intake port 28 is open. This adjustability improves performance at all operating engine speeds.

FIG. 13 illustrates an embodiment of the sliding throttle plate 102 located within the rotary valve 25. FIG. 14 is a cross-sectional view taken along line XIV—XIV of FIG. 13. A throttle control rod 106 is arranged at the center of the valve body 26. A wing 108 illustrated in FIGS. 13 and 14 provides support for a stem 110 (see FIG. 14) that supports the sliding throttle plate 102. As shown in detail in FIG. 14, the sliding throttle plate 102 slides within inserts 112 located on each side of the intake port 28. The inserts 112 are preferably made of TEFLON® or other low friction material that is resistant to high temperatures, chemicals and fuels, and is generally long-lasting.

Referring back to FIG. 13, a bearing 114 is connected to the throttle control rod 106. The throttle actuator 104 is connected at the end of the rod 106. Throttle movement is provided in a direction indicated by arrow X. The direction of rotation of the body 26 of the rotary valve 25 is indicated by arrow R. The TEFLON® inserts 112 provide smooth guiding for the throttle plate 102.

As further illustrated in FIG. 15, the throttle movement in direction X translates to a movement of the sliding throttle plate 102 in various positions of coverage over the intake port 28. As illustrated in FIG. 15, as the throttle is adjusted, the sliding throttle plate 102 changes position. Various possible positions of the sliding throttle plate 102 are shown in dashed lines. The various positions of the sliding throttle plate 102 relative to the engine speed will now be described.

For example, position 102*a* indicates a wide open throttle so that the intake port 28 is fully opened and no portion of the sliding throttle plate 102 obscures the intake port 28. Position 102*b* indicates an acceleration mode in which the intake port 28 is partially open. Positions 102*c* indicate various cruising speeds in which the intake port 28 is primarily closed off by the sliding throttle plate 102. Finally, position 102*d* indicates an idling condition of the engine. The various degrees to which the intake port 28 is open as regulated by the sliding throttle plate 102 advantageously improves performance at different engine speeds.

Another important aspect of the present invention lies in providing the secondary intake port 34 for controlling the flow of intake gas into the rotary valve 25. FIG. 2 illustrates the secondary intake port 34 on the fresh air side of the rotary valve 25. The secondary intake port 34 is provided to harmonize the air flow inside the rotary valve 25 and to eliminate irregular or erratic fluctuations behind the intake port 28. The secondary intake port 34 is larger than the main intake port 28 thereby enabling the flow of more air into the main intake port 28 which prevents choking the intake port 28. The secondary intake port 34 opens to the fresh air inflow port 38*a* before the main intake port 28 opens to the combustion chamber 18 and also closes at about the same time that the main port 28 closes to the combustion chamber 18. An advantage of such a design of the secondary intake port 34 is to maintain even pressures within the tube and to use wave-like motion instead of digital motion which is created by opening and closing the intake port 28.

The relative timing and positions of the inflow port 38*a*, the secondary intake port 34 and the main intake port 28 are illustrated in FIGS. 16*a*–16*c*. FIG. 16*a* indicates when the intake port 28 and the secondary intake port 34 are both closed, and there is no overlap between them. FIG. 16B illustrates that the overlap between the secondary intake port 34 and the inflow port 38*a* is approximately 10% when the intake port 28 is correspondingly approximately 10% open to the combustion chamber 18. Similarly, FIG. 16*c* indicates that as the rotary valve 25 rotates in a direction indicated by arrow R in FIGS. 16*a*–16*c* that an overlap of approximately 90% between the secondary port 34 and the inflow port 38*a* is achieved when the opening is 90% between the intake port 28 and the combustion chamber 18. Thus, the timing and positions of the secondary intake port 34, the inflow port 38*a* and the main intake port 28 are coordinated to provide the advantages discussed above.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A rotary valve and engine head combination comprising:

an engine head including a generally cylindrical bore defining a inflow port at an end of said bore and a head port in communication with a combustion chamber, said head being connected to an air intake and an exhaust;

a housing mounted to said head and positioned above said head port;

a rotary valve including an elongated valve body having a first end and a second end and a longitudinally extending axis of rotation, said valve body being rotably mounted within said housing;

an intake port and an exhaust port defined by said valve body arranged for periodic communication with said head port as said valve body rotates about said axis of rotation;

intake passageway means for providing a passage between said first end of said valve body and said intake port;

exhaust passageway means for providing a passage between said second end of said valve body and said exhaust port; and a secondary intake port arranged in said first end of said valve body to periodically communicate with said inflow port as said rotary valve rotates about said axis of rotation.

2. The combination of claim 1 in which said secondary intake port is positioned such that, when said valve body rotates about said axis of rotation, said secondary intake port is rotated into communication with said inflow port before said intake port is rotated into communication with said head port.

3. The combination of claim 1 in which said secondary intake port is positioned such that, when said valve body rotates about said axis of rotation, said secondary intake port is rotated out of communication with said inflow port simultaneously when said intake port is rotated out of communication with said head port.

4. The combination of claim 1 in which said secondary intake port is positioned such that, when said valve body rotates about said axis of rotation, said secondary intake port overlaps with said inflow port an amount approximately equal to an amount of an opening between said intake port and said head port.

5. The combination of claim 1 in which said head includes a concave surface shaped to cover the combustion chamber and said head port extends between said bore and said concave surface, said valve body further including a concave outer wall portion which defines said intake and exhaust ports and extends over said main port of said head such that said valve body does not project beyond said concave surface of said head.

6. The combination of claim 1 in which said secondary intake port is larger than said intake port.

7. The combination of claim 1 in which said engine head includes a plurality of cylindrical bores in communication with a plurality of combustion chambers and a plurality of said rotary valves individually positioned over each of said plurality of combustion chambers.

8. The rotary valve of claim 1 wherein said valve body has a curvature equal to the curvature of the combustion chamber.

9. The rotary valve of claim 1 wherein said rotary valve and engine head combination further comprises a plurality of rotary valves.

* * * * *